US009487956B2

(12) United States Patent
Day et al.

(10) Patent No.: US 9,487,956 B2
(45) Date of Patent: Nov. 8, 2016

(54) CLADDING ASSEMBLY

(71) Applicants: Simon Day, Chambers Flat (AU); Richard Anthony Lee, Laidley (AU)

(72) Inventors: Simon Day, Chambers Flat (AU); Richard Anthony Lee, Laidley (AU)

( * ) Notice: Subject to any disclaimer, the term of this patent is extended or adjusted under 35 U.S.C. 154(b) by 0 days.

(21) Appl. No.: 14/440,323

(22) PCT Filed: Nov. 6, 2013

(86) PCT No.: PCT/AU2013/001284
§ 371 (c)(1),
(2) Date: May 1, 2015

(87) PCT Pub. No.: WO2014/071450
PCT Pub. Date: May 15, 2014

(65) Prior Publication Data

US 2015/0300027 A1 Oct. 22, 2015

(30) Foreign Application Priority Data

Nov. 6, 2012 (AU) ..... 2012904872

(51) Int. Cl.
*E04F 13/08* (2006.01)
*E04F 13/12* (2006.01)
*E04F 13/073* (2006.01)

(52) U.S. Cl.
CPC ..... *E04F 13/0801* (2013.01); *E04F 13/0825* (2013.01); *E04F 13/0826* (2013.01); *E04F 13/0862* (2013.01); *E04F 13/12* (2013.01); *E04F 13/0736* (2013.01); *E04F 13/0807* (2013.01)

(58) Field of Classification Search
CPC ..... E04B 2/90; E04B 2/96; E04B 2/721; E04B 2/30; E04B 2/965; E04F 13/083; E04F 13/0816; E04F 19/061; E04F 19/062; E04F 13/0846; E04F 13/0807; E04F 13/0862; E04F 13/0801; E04F 13/0875; E04F 13/0736; E06B 3/96; E06B 3/9682; E06B 3/9645
USPC ..... 52/235, 489.1, 506.05, 506.06, 507, 52/509–512, 463, 464, 656.1, 656.9
See application file for complete search history.

(56) References Cited

U.S. PATENT DOCUMENTS 2,816,632 A * 12/1957 Nardulli ..... E06B 3/92 403/295
3,007,558 A * 11/1961 Miller ..... A47H 1/06 52/235
3,388,517 A * 6/1968 Wohl ..... E06B 3/62 52/204.591

(Continued)

FOREIGN PATENT DOCUMENTS

EP 1604076 B1 5/2008

*Primary Examiner* — Beth Stephan
(74) *Attorney, Agent, or Firm* — Greenberg Traurig, LLP

(57) ABSTRACT

The present invention concerns a frame member (10), a frame formed from the frame member (10) and a panel including the frame for use in a cladding assembly for cladding a structure. The frame member (10) of the present invention is adapted to be joined together with other frame members (10) to form the frame, each frame member (10) includes at least four walls including an inner frame wall (11), an opposed outer frame wall (12), a panel abutting wall (13) and an opposed structure abutting wall (14) having a free end (15) with an outer edge protrusion (16). A receiving opening (19) is defined between a portion of the outer frame wall (12) and the outer edge protrusion (16) for receiving one or more fasteners which engage the outer edge protrusion (16) for, in use, fastening the frame member (10) and thereby the frame and preformed panel to the structure.

16 Claims, 24 Drawing Sheets

(56) References Cited

U.S. PATENT DOCUMENTS 3,429,602 A * 2/1969 Dirilgen ..... E04B 1/2403 403/295
3,455,080 A * 7/1969 Meadows ..... E06B 3/549 52/204.597
4,831,804 A * 5/1989 Sayer ..... E06B 3/222 52/204.593
5,046,791 A * 9/1991 Kooiman ..... A47B 47/0025 312/265.1
5,065,557 A * 11/1991 Laplante ..... E06B 3/5427 52/235
5,155,958 A * 10/1992 Huff ..... E04F 13/0826 52/204.593
5,544,461 A * 8/1996 Sommerstein ..... E04F 13/0807 52/235
5,657,591 A * 8/1997 Kitada ..... E06B 3/5454 49/501
5,671,580 A * 9/1997 Chou ..... E06B 3/968 403/230
6,067,760 A * 5/2000 Nowell ..... E06B 3/26347 403/231
6,973,953 B2 * 12/2005 Winner ..... E06B 9/52 160/381
7,677,003 B2 * 3/2010 Baughn ..... E06B 3/9682 52/473
7,937,902 B1 * 5/2011 Smith ..... E04F 13/0889 52/235
8,127,507 B1 * 3/2012 Bilge ..... E04F 13/0814 52/235
2005/0210777 A1 * 9/2005 Baughn ..... E06B 3/9682 52/202
2007/0022682 A1 2/2007 Morgenegg
2007/0234677 A1 * 10/2007 Sironko ..... E06B 3/9612 52/656.1
2009/0031652 A1 * 2/2009 Ortega Gatalan .... E04F 13/081 52/235
2009/0241451 A1 * 10/2009 Griffiths ..... E04F 13/081 52/309.4
2010/0263314 A1 * 10/2010 Macdonald ..... E04F 13/0826 52/506.05
2011/0252731 A1 * 10/2011 Boyer ..... E04F 13/0817 52/302.1
2011/0283635 A1 * 11/2011 Sato ..... F24J 2/0444 52/173.3
2012/0017530 A1 * 1/2012 Hummel, III ..... E04F 13/081 52/506.05
2012/0297725 A1 * 11/2012 Anastasi ..... E04F 13/0807 52/705

* cited by examiner

Figure 7A
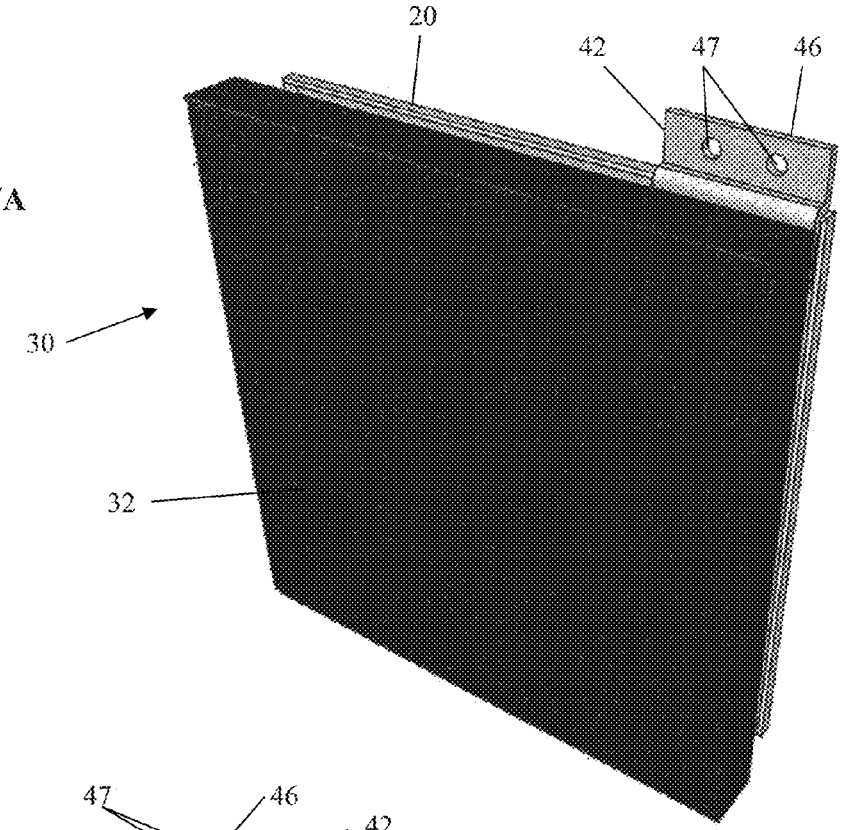
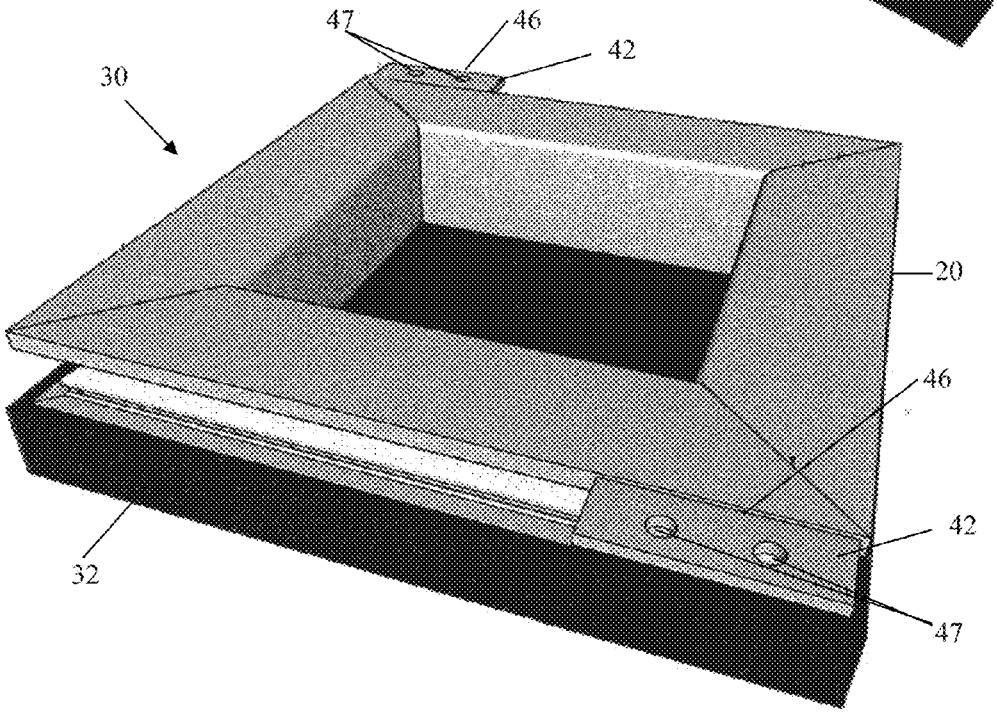
Figure 7B

CLADDING ASSEMBLY

CROSS REFERENCE TO RELATED APPLICATIONS

This application claims priority from International Application No. PCT/AU2013/001284, filed on Nov. 6, 2013, which in turn claims priority from Australian Patent Application No. 2012904872, filed on Nov. 6, 2012, both of which are incorporated herein by reference in their entireties.

TECHNICAL FIELD

The present invention relates to a cladding assembly for attachment to an external surface of a structure or building. In particular, the present invention relates to a preformed panel for use in a cladding assembly.

BACKGROUND ART

The facade or external appearance of a structure or building is often one of the most important visual aspects of the structure or building from a design standpoint.

The advent of modern building practices through the use of structural steel and reinforced concrete has dramatically changed the way facades are used. The importance of load-bearing walls has diminished, which, in turn, has resulted in a decreased use of traditional masonry facades and an increased use of modern cladding systems that are suspended from or attached to a structure or building to form a facade.

A problem associated with typical modern cladding systems is that they are labour intensive and time consuming to assemble and install. This is because, typically, each cladding unit is assembled on site from multiple parts and individually suspended from or attached to a structure or building. The act of installing a typical cladding unit is particularly labour intensive and time consuming, often initially requiring the fitting of various frames and brackets to the structure or building prior to fitting the actual cladding.

As such, a further and resultant problem associated with typical modern cladding systems is that they are expensive.

A yet further problem associated with typical cladding systems is that they are not readily compatible with other modern cladding systems. For instance, a structure or building may incorporate portions of curtain walling suspended from concrete floor slabs with portions of other modern cladding systems to achieve a desired aesthetic effect. However, as briefly alluded to above, the installation process is typically difficult requiring onsite engineering and there is no guarantee that the resulting join between the two types of cladding systems will not detract from the desired aesthetic effect.

Thus, there is a need for an improved or alternate cladding system.

SUMMARY OF INVENTION

It is an object of the present invention to provide an improved or alternate cladding system. In particular, a cladding assembly that may at least partially overcome at least one of the abovementioned disadvantages or provide the consumer with a useful or commercial choice.

With the foregoing in view, a first aspect of the present invention resides broadly in a frame member adapted to be joined together with at least one other frame member to form a frame of a preformed panel, said frame member including:

at least four walls including an inner frame wall, an opposed outer frame wall, a panel abutting wall and an opposed structure abutting wall having a free end with an outer edge protrusion; and at least two ends, each end adapted to be operatively associated with a joining component for joining the frame member with the at least one other frame member, wherein a receiving opening is defined between a portion of the outer frame wall and the outer edge protrusion for receiving one or more fasteners which engage the outer edge protrusion for, in use, fastening the frame member and thereby the frame of the preformed panel to a structure.

In an embodiment, the frame member includes:

at least two ends, each end defining an opening for at least partially receiving the joining component for joining the frame member with the at least one other frame member to form the frame.

In another embodiment, the frame member includes:

at least two ends, each end defining an opening for at least partially receiving a joining component for joining a first frame member with a second frame member to form the frame.

According to a second aspect of the present invention, there is provided a frame member adapted to be joined together with at least one other frame member to form a frame of a preformed panel, said frame member including:

at least four walls including an inner frame wall, an opposed outer frame wall, a panel abutting wall and an opposed structure abutting wall having a free end with an outer edge protrusion, wherein a receiving opening is defined between a portion of the outer frame wall and the outer edge protrusion for receiving one or more fasteners which engage the outer edge protrusion for, in use, fastening the frame member and thereby the frame of the preformed panel to a structure, and wherein at least one wall of the frame member defines at least one shoulder configured to have a joining component clamp over the at least one shoulder for joining the frame member with the at least one other frame member to form the frame.

According to a third aspect of the present invention, there is provided a frame of a preformed panel for use in a cladding assembly for cladding a structure, said frame including:

at least two frame members each as defined in the first or second aspects and joined together to form the frame; and at least two joining components, each joining component operatively associated with each frame member to join the at least two frame members together, wherein each frame member defines a receiving opening for at least partially receiving one or more fasteners for fastening the frame member and thereby, in use, the frame of the preformed panel to the structure.

In an embodiment, the frame includes:

at least two joining components, each joining component at least partially received by a first frame member and a second frame member for joining the first frame member with the second frame member, wherein each frame member includes:

at least four walls including an inner frame wall, an opposed outer frame wall, a panel abutting wall and an opposed structure abutting wall having a free end with an outer edge protrusion;

at least two ends, each end defining an opening for at least partially receiving the joining component; and a receiving opening defined between a portion of the outer frame wall and the outer edge protrusion for receiving one or more fasteners which engage the outer edge protrusion for fastening the frame member and thereby the frame and, in use, the preformed panel to the structure.

In another embodiment, the frame includes:

at least two frame members each as defined in the first aspect joined together to form the frame; and at least two joining components, each joining component at least partially received by a first frame member and a second frame member for joining the first frame member with the second frame member.

According to a fourth aspect of the present invention, there is provided a preformed panel for use in a cladding assembly for cladding a structure, the performed panel including:

a frame as defined in the third aspect;

at least two joining components, each joining component operatively associated with each frame member to join the at least two frame members together; and a panel operatively associated with the frame, wherein each frame member defines a receiving opening for at least partially receiving one or more fasteners for fastening the frame member and thereby the frame of the preformed panel to the structure.

In an embodiment, the preformed panel includes:

a frame formed from at least two frame members joined together;

at least two joining components, each joining component being at least partially received by a first frame member and another frame member to join the frame members together; and a panel operatively associated with the frame, wherein each frame member includes:

at least four walls including an inner frame wall, an opposed outer frame wall, a panel abutting wall and an opposed structure abutting wall having a free end with an outer edge protrusion;

at least two ends, each end defining an opening for at least partially receiving the joining component; and a receiving opening defined between a portion of the outer frame wall and the outer edge protrusion for receiving one or more fasteners which engage the outer edge protrusion for, in use, fastening the frame member and thereby the frame and the preformed panel to the structure.

In another embodiment, the preformed panel includes:

a frame as defined in the third aspect;

at least two joining components, each joining component at least partially received by a first frame member and a second frame member for joining the first frame member with the second frame member to form the frame; and a panel operatively associated with the frame, wherein each frame member defines a receiving opening for at least partially receiving one or more fasteners for fastening the frame member and thereby the frame and the preformed panel to the structure.

According to a fifth aspect of the present invention, there is provided a cladding assembly for cladding a structure, the cladding assembly including:

a plurality of preformed panels as defined in the fourth aspect; and one or more fasteners for fastening the frames of the preformed panels to the structure.

In an embodiment, the cladding assembly includes:

a plurality of preformed panels as defined in the fourth aspect; and one or more fasteners for fastening the preformed panels to the structure, wherein each preformed panel includes:

a frame formed from at least two frame members joined together, each frame member having at least four walls including an inner frame wall, an opposed outer frame wall, a panel abutting wall and an opposed structure abutting wall having a free end with an outer edge protrusion, and at least two ends, each end defining an opening;

at least two joining components, each joining component adapted to be at least partially received by the opening of a first frame member and another frame member for joining the first frame member with the another frame member to form the frame;

a panel operatively associated with the frame; and at least two receiving openings, each receiving opening defined between a portion of the outer frame wall and the outer edge protrusion of a frame member for receiving the one or more fasteners which engage with the outer edge protrusion for, in use, fastening the frame member and thereby the frame of the preformed panel to the structure.

Advantageously, the cladding assembly may be readily installed on site by engaging one or more fasteners with each preformed panel and fastening the preformed panels via the attached fasteners to a structure or building. By providing preformed panels that already include an assembled frame, the cladding assembly of the present invention may be quickly installed with installers on site only needing to attach one or more fasteners to each preformed panel prior to fastening the preformed panel to the structure. Therefore, the cladding assembly of the present invention is less time consuming and labour intensive to install compared to typical cladding systems. Subsequently, the cladding assembly of the present invention may provide a cost-effective alternative to typical cladding systems. Due to the simplified installation process and the preformed nature of the cladding assembly in including an already assembled frame, the cladding assembly of the present invention may also be readily installed adjacent other forms of cladding and the like.

The frame of the preformed panel may be of any suitable size, shape and construction and formed from any suitable material or materials. The frame may have any desired shape to support a panel of any desired shape. The frame may be square-shaped, rectangular, circular, triangular, pentagonal, hexagonal, heptagonal, octagonal or any variation or combination thereof Typically, the frame may have any polygonal shape suitable for tiling. Preferably, the frame may be square-shaped, triangular, rectangular or hexagonal, more preferably square-shaped or rectangular.

The frame may be formed from any suitable number of frame members. The frame may be formed from at least two frame members. Preferably, the frame may be formed from at least four frame members.

Each frame member may be of any suitable size, shape and construction and formed from any suitable material or materials. Each frame member may have an elongate shape. The frame members may be linear or curved, preferably linear. Furthermore, each frame member may include one or more bends.

The frame members may have any suitable profile shape that provides at least four walls including an inner frame wall, an outer frame wall, a panel abutting wall and a structure abutting wall.

For instance, the frame members may have a profile shape that is square-shaped, rectangular, pentagonal, hexagonal, heptagonal, octagonal or any variation or combination thereof. Typically, each frame member may have a profile shape that is substantially square or rectangular in shape.

Each frame member may have at least two ends, each end adapted to be connectable either directly or indirectly with other ends of other frame members to assemble the frame.

The frame members forming the frame may be of like profile shape or not. Furthermore, the frame members forming the frame may have the same longitudinal length or may have differing lengths, for instance, to form frames that are rectangular in shape or any shape with sides of differing lengths.

The frame members may be formed from metal or plastic, preferably metal, such as, for example, corrosion resistant metal. Most preferably, the frame members may be formed from aluminium, titanium or a composite thereof The frame members may be constructed by any suitable means. For instance, the frame members may be machine folded from sheet metal or may be extrusions. Typically, the frame members may be extrusions.

As indicated above, the frame members may be joined or connected end to end either directly or indirectly to one another by any suitable means to form the frame.

The frame members may be joined together end to end at any suitable angle relative to one another to form a frame of any desired shape. In most instances, the frame members may be joined end to end at right angles/90°. Typically, each join may include at least two frame members.

Any type of join may be used between adjacent frame members. If the frame members are directly joined or connected end to end, the join may be a butt joint, a mitre joint, a lap joint, box joint, dovetail joint, a daddo joint or a mortise and tenon joint, typically a butt joint or mitre joint, preferably a mitre joint.

Each frame member may include a first end having a female formation and a second end having a male formation. The frame members may be joined end to end by having the male formation at a first end of a first frame member engage the female formation at a second end of a second frame member.

Typically, the frame members may be joined together end to end via a joining component adapted to be operatively associated with or neat the respective ends of the frame members to be joined together. Each join may include one or more joining components.

The joining component may be operatively associated with the respective ends of the frame members by any suitable means. For instance, the joining component may be fastened to each of the frame members by one or more fasteners or adhesives.

Regarding the first aspect of the present invention, the frame members may be joined together via at least one joining component adapted to be at least partially received in an opening defined in the respective ends of the frame members to be joined.

The joining component may be of any suitable size, shape and form and be formed from any suitable material or materials to be at least partially received within the respective ends of frame members being joined together. The joining component may, for instance, be a corner connector, a biscuit joiner, a plate joiner or a domino joiner. Preferably, the joining component may be formed from a resilient and durable material such as, for instance, a plastics material or metal.

In a first embodiment, the joining component may be configured to be used with frame members having "profiled" ends such that the ends may mate and be connected or joined directly to each other via the joining component such that the two ends joined meet flush. The joining component may be an elongate member including two portions, each portion adapted to be at least partially received within the openings, which may be in the form of slots defined in each end of the frame members to be joined. The two portions of the joining component may be angled at any suitable angle to one another to achieve the desired angle of the join between the two frame members. For instance, to form a frame that may be square-shaped or rectangular, the joining component may be substantially L-shaped.

Each slot may be defined in any suitable location at the end of each frame member to be joined. Preferably, the slot may be located adjacent the inner frame wall of each frame member and may extend the length of the frame member.

The slot defined at each end of each frame member may be defined by the inner frame wall, the panel abutting wall, the structure abutting wall and at least two opposed projections, the projections extending inwardly from the panel abutting wall and the structure abutting wall, respectively.

The at least two opposed projections may be located at any suitable location on the panel abutting wall and the structure abutting wall to define a suitably sized slot for at least partially receiving the portion of the joining component. Preferably, the opposed projections are located near the inner frame wall.

The ends of each frame member may further include one or more guiding members located adjacent and/or within the slot for guiding a portion of the joining component at least partially received within the slot. The one or more guiding members may also at least partially force or urge the at least partially received portion of the joining component against the inner surface of the inner frame wall to, in use, at least frictionally engage or secure the portion against the inner surface of the inner frame wall of the frame member.

The one or more guiding members may be of any suitable size, shape and constructions and formed from any suitable material or materials. Typically, the one or more guiding members may be formed of metal and configured to resiliently guide a partially received portion of the joining component towards the inner surface of the inner frame wall of the frame member.

The guiding members may be located at or near the ends of each opposed projection and may include an end portion of each projection being angled toward the inner frame wall. Preferably, the engaging surface of the guiding members that engages with and guides an at least partially received portion of the joining component may be a rounded surface.

The ends of each frame may further include one or more positioning members located within the slot opposite the guiding members for guiding, positioning and receiving the portion of the joining component at least partially received within the slot. The one or more positioning members may be located opposite the guiding member and may extend inwardly from the inner frame wall towards the guiding members.

Preferably, the guiding members together with the positioning members may snugly receive the portion of the joining component at least partially received in the slot to, in use, at least frictionally engage or secure the portion between the guiding and positioning members.

Preferably, once two frame members are joined together the joining component may not be visible.

In a second embodiment, the joining component may be in the form of a corner connector configured to connect frame members having square cut ends. Each frame member may define the opening in the form of a channel at each square cut end to allow a corner connector to be fitted into the channel thereby enabling the frame to be assembled.

Typically, the corner connector may have a substantially L-shaped configuration that allows a first part of the corner connector to be at least partially received in an end of a first frame member and a second part to be at least partially received in an adjacent end of a second frame member to be joined or connected to the first frame member.

The channel defined at each end of the frame members to be joined or connected may be suitably sized and shaped to snugly receive the first and second parts of the corner connector. Each channel may be defined by the panel abutting wall, the outer frame wall, the structure abutting wall, the at least two opposed projections and the inner frame wall.

Likewise, the first and second parts of the corner connector may be suitably sized and shaped to be snugly received in the respective channels defined by the ends of each frame member to be joined. Preferably, the first and second parts of the corner connector may be frictionally fitted into the channels.

The corner connector may be formed from any suitable material or materials and may be of unitary construction or may include one or more component pieces. Typically, the corner connector may be formed from a plastics material and may be injection moulded.

Regarding the second aspect of the present invention, the joining component may clamp over the at least one shoulder defined on at least one wall of a first frame member and the at least one shoulder defined on at least one wall of a second frame member to join the fame members together. Typically, the joining component may be attached at or near the ends of the frame members to be joined and may clamp over the at least one shoulder defined by the at least one wall of each frame member to be joined in any suitable way.

The joining component may be of any suitable size, shape and construction and formed from any suitable material or materials to join the frame members together.

The joining component may be of unitary construction or may include two or more joining component pieces.

Typically, the joining component may include at least two component pieces, each component piece attachable to one of the frame members to be joined. Preferably, the at least two joining component pieces may be hinged together such that in use any desirable corner or join angle between the two joined frame members may be obtained.

Each joining component piece may be of unitary, one piece construction and have a substantially T-shaped cross section. The joining component piece may include an elongate frame coupling member having at least one projection with an enlarged end portion extending outwardly from an outer longitudinal edge for clamping or hooking over the at least one shoulder defined by the at least one wall of a first frame member to be joined. The joining component piece may further include a hinge member intersecting and extending outwardly and intermediate the outer longitudinal edges of the elongate frame member. The hinge member may be adapted to be rotatably coupled to the hinge member of a like joining component piece attached to a second frame member to be joined to the first frame member. Preferably, each hinge member may include a bevelled corner located adjacent the pivot point or location where the hinge member is rotatably coupled to the hinge member of a like joining component piece to facilitate rotation relative to the other like joining component piece.

The hinge members from the respective joining component pieces may be rotatably coupled by any suitable means. Typically, however, the hinge members may be rotatably coupled by way of a fastener such as a threaded or mechanical fastener received in co-aligned apertures defined by the respective hinge members. In this way, the join angle between two joined frame members may be adjusted by loosening the fastener adjusting the angle between the two joined frame members and tightening the fastener.

Typically, the frame coupling member of each joining component piece may clamp over the at least one shoulder defined on the inner frame wall of the frame member. Preferably, at least two shoulders may be defined on the inner frame wall. Typically, the at least two shoulders will be defined along the outer edges of the inner frame wall and will extend the length of the frame member.

Likewise, in a preferred embodiment the frame coupling member may have at least two projections each with an enlarged end portion and each extending from an outer longitudinal edge of the frame coupling member for clamping over the at least two shoulders.

In use, the at least two projections with enlarged end portions may hook over the at least two shoulders defined by the inner frame wall to prevent disengagement of the joining component piece from the frame member other than by sliding the joining component piece over an end of the frame member. In particular, the at least two projections having enlarged end portions may hook over the at least two shoulders of the inner frame wall and may be received in corresponding channels or grooves defined in the panel abutting wall and the structure abutting wall of the frame member.

Each join may be further supported by a supporting member, which may be attached by any suitable means to the at least two frame members forming the join. The supporting member may be a brace, bracket or the like suitably adapted to support and maintain the relevant angle at which the at least two frame members are joined.

Each frame member may further include a receiving opening defined between a portion of the outer frame wall and the outer edge protrusion for receiving one or more fasteners. The receiving opening may be of any suitable size, shape and form for receiving the one or more fasteners.

Typically, the receiving opening may be a suitably sized and shaped groove or depression defined between the portion of the outer frame wall and the outer edge protrusion. The groove or depression may extend along the length of each frame member. Alternatively, the groove or depression may only be defined at one or more locations along the length of each frame member. Preferably, the groove or depression may extend along the length of each frame member.

The receiving opening may further be suitably sized and shaped for receiving a joint strip and/or joint strip support, which may, in use, be positioned between adjacently positioned preformed panels or other cladding systems and the like. Typically, the joint strip and/or joint strip support may be positioned within the receiving opening to at least partially cover the one or more fasteners. Preferably, the joint strip and/or joint strip support may extend along the length of the frame member within the receiving opening.

The one or more fasteners used to fasten a frame member and thereby, in use, the frame and preformed panel to a structure or building may be of any suitable size, shape and form and may be formed from any suitable material or materials.

The fasteners may include threaded fasteners, mechanical fasteners or the like, said fasteners may be adapted to be received in the receiving opening and may fasten a frame member to the structure via one or more apertures defined in the structure abutting wall of the frame member.

In a preferred embodiment, the fasteners may include one or more tags. Each tag may be adapted to be associated with a frame member via the receiving opening. Each tag may define one or more apertures. Each aperture may be adapted to at least partially receive a threaded fastener, mechanical fastener or the like for fastening the tag and thereby the frame member and, in use, the frame and preformed panel to a structure or building. Preferably, each tag may be formed from metal, more preferably corrosion resistant metal.

In a preferred embodiment, each tag may be a substantially planar member with a frame member abutting portion, a structure abutting portion and shaped groove defined therebetween, said shaped groove being adapted to, in use, at least partially receive and engage with the outer edge protrusion when the tag is associated with a frame member via the receiving opening.

Preferably, the shaped groove is sized and shaped to snap-fit with the outer edge protrusion. This may be achieved by the outer edge protrusion having at least two portions of differing dimensions, a first portion with a first dimension adjacent the edge and a second portion of a dimension larger than the first dimension at the edge. Likewise, the shaped groove may be complementarily-shaped to receive the outer edge protrusion. In use, engagement of the outer edge protrusion with the shaped groove may involve resilient deformation of an outer edge of the shaped groove to receive the second portion of outer edge protrusion.

A person skilled in the art will realise that the shaped groove is configured to allow resilient deformation of the outer edge of the shaped groove without detracting from the structural integrity of the shaped groove in securely engaging the outer edge protrusion when snap-fitted together.

In a preferred embodiment, the receiving opening may include an angled wall for, in use, positively positioning the frame member abutting portion of the tag against the inner surface of the structure abutting wall of the frame member. In use, the angled wall may guide the frame member abutting portion of the tag into the correct position prior to the outer edge protrusion being snap-fitted into the shaped groove of the tag.

In use, the angled wall feature and snap-fitting of the outer edge protrusion with the shaped groove may provide tactile and audible feedback to an installer attaching the fasteners to the frame. This advantageously allows the installer to attach the fasteners quickly without necessarily relying on visual cues.

Preferably the structure abutting portion of the tag may define one or more apertures sized and shaped to receive one or more threaded or mechanical fasteners or the like for fastening the tag to the structure.

Typically, the tag when associated with a frame member may be positioned such that the tag extends from the edge of the frame member and lies substantially in plane with the structure abutting wall of the frame member. However, in some instances, it may be desirable that the tag extending from the edge of the frame member does not lie in plane with the structure abutting wall of the frame member, e.g., to allow tags from adjacent frames to be fastened to the structure or building one atop of another with a single threaded or mechanical fastener or the like.

Typically, the assembly of the present invention may, in use, be fastened to a structure or building with at least two tags positioned on substantially opposite sides of the frame of the assembly.

The panel of the present invention may be of any suitable size and shape to be operatively associated with the frame of the present invention. A person skilled in the art will realise that any type of conventional panel used with existing cladding systems may be used in the preformed panels of the present invention. Thus, in no way should the present invention be limited to the type of panel.

The panel may be operatively associated with the frame by being at least partially fitted over the frame or may be fastened to the frame either directly or indirectly by one or more brackets or couplers. The panel may further be secured in place by any suitable means such as, for instance, architectural adhesive or one or more threaded or mechanical fasteners.

In an embodiment, one or more brackets may be used to fasten the panel to the frame. Each bracket may have a substantially L-shaped cross section having a first portion that may be fastened to either an inner frame wall or outer frame wall of a frame member forming the frame, and a second portion adapted to abut and be fastened to an inwardly facing face or frame facing face of the panel. The two portions may define one or more apertures sized and shaped to receive threaded or mechanical fasteners or the like for fastening the portions to the frame member and the panel, respectively.

In another embodiment, a coupler adapted to be associated with a frame member may be used to fasten the panel to the frame.

The coupler may be of any suitable size, shape and construction and formed from any suitable material or materials. Furthermore, the coupler may be associated with the frame member by any suitable means. The coupler may be of one piece or multi-piece construction.

Preferably, the coupler may be of unitary, one piece construction and may have a panel abutting or fastening member and a frame coupling member as preciously described extending substantially perpendicular relative to the panel abutting or fastening member from a common or shared edge of the panel abutting or fastening member. The coupler may have a substantially L-shaped cross section.

The frame coupling member of the coupler may couple to a frame member in a similar way as with the joining component of the second aspect. That is, clamp over at least one shoulder defined by the inner frame wall of the frame member. Preferably, the frame coupling member may clamp over at least two shoulders defined along the longitudinal edges of the inner frame wall of the frame member.

Preferably, the frame coupling member of the coupler may couple to the frame member such that the panel abutting or fastening member is substantially planar with the panel abutting wall of the frame member.

Once coupled to the frame member, the panel abutting or fastening member of the coupler may be fastened to the panel by one or more threaded or mechanical fasteners via one or more apertures defined in the panel abutting or fastening member.

The panel may be further secured or fastened to the frame by way of one or more edge covers adapted to clip, hook or clamp by way of hooks or clips over an outer edge of the panel and an outer and/or inner edge of the outer frame wall of a frame member of the frame. In use, edge covers may be attached to any or all edges of a panel fastened to a frame. The edge cover may also be fastened to the outer frame wall of a frame member by one or more threaded or mechanical fasteners.

Each edge cover may be provided in a colour and texture to match that of the panel it is attached to or not.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIGS. 7A and 7B respectively are perspective views of the front and rear sides of the preformed panel shown in FIG. 6;

DETAILED DESCRIPTION

Figure 1:
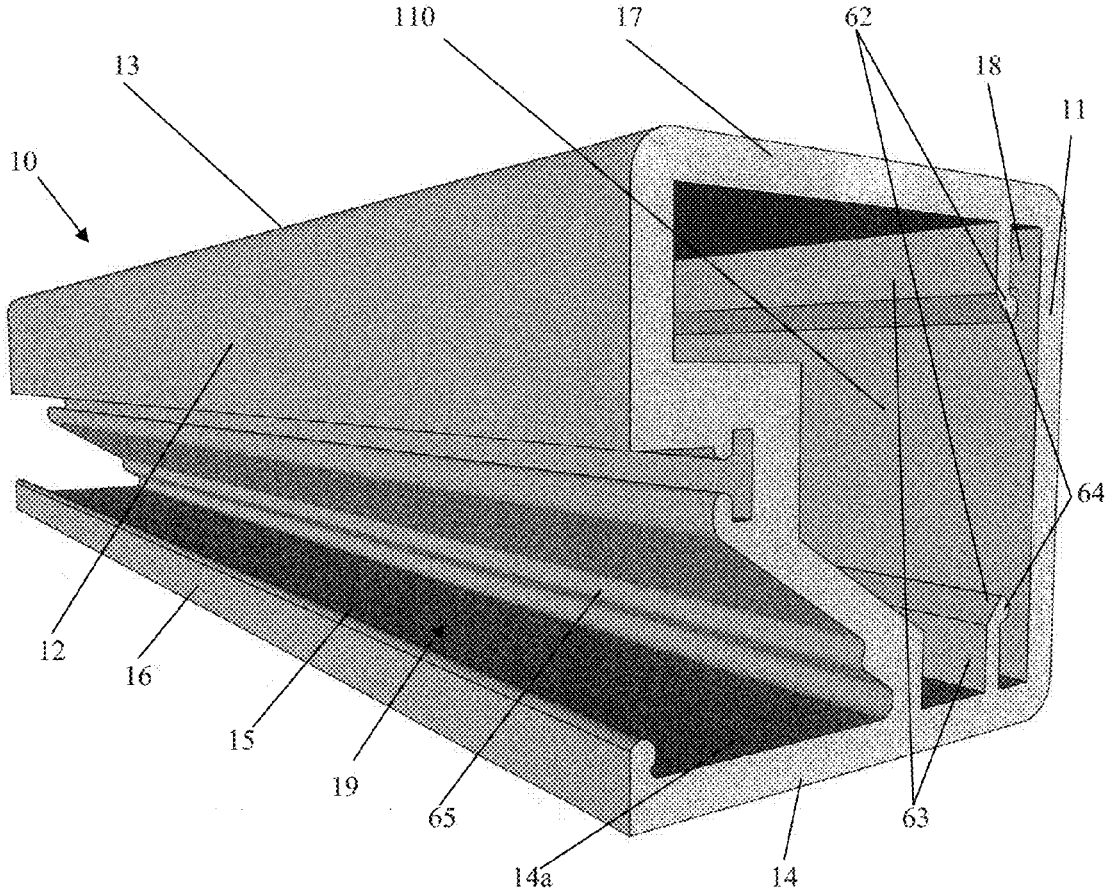
FIG. 1 is a perspective end view of a frame member according to an embodiment of the present invention.

FIG. 1, in particular, shows a frame member (10) adapted to be joined together with other frame members to form a frame of a preformed panel. The frame member (10) includes at least four walls including an inner frame wall (11), an opposed outer frame wall (12), a panel abutting wall (13) and an opposed structure abutting wall (14) with a free end (15) having an outer edge protrusion (16). The frame member (10) includes at least two ends (17), each end (17) defining a slot (18) and channel (110) each of which is capable of at least partially receiving a joining component for joining the frame member (10) with another frame member to form the frame. A receiving opening (19) is defined between a portion of the outer frame wall (12) and the outer edge protrusion (16) for receiving one or more tags (i.e., fasteners) which engage the outer edge protrusion (16) for, in use, fastening the frame member (10) and thereby the preformed panel to a structure.

FIGS. 2A to 2C and 3A to 3C, in particular, show the frame (20) of the preformed panel for use in the cladding assembly for cladding a structure. The frame (20) includes four frame members (10) joined together to form the frame (20) and four joining components (22; shown in FIGS. 2B and 3B), each joining component (22; shown in FIGS. 2B and 3B) is at least partially received in the slot (18) defined at the end (17) of each frame member (10) to join the frame members (10) together.

Figure 6:
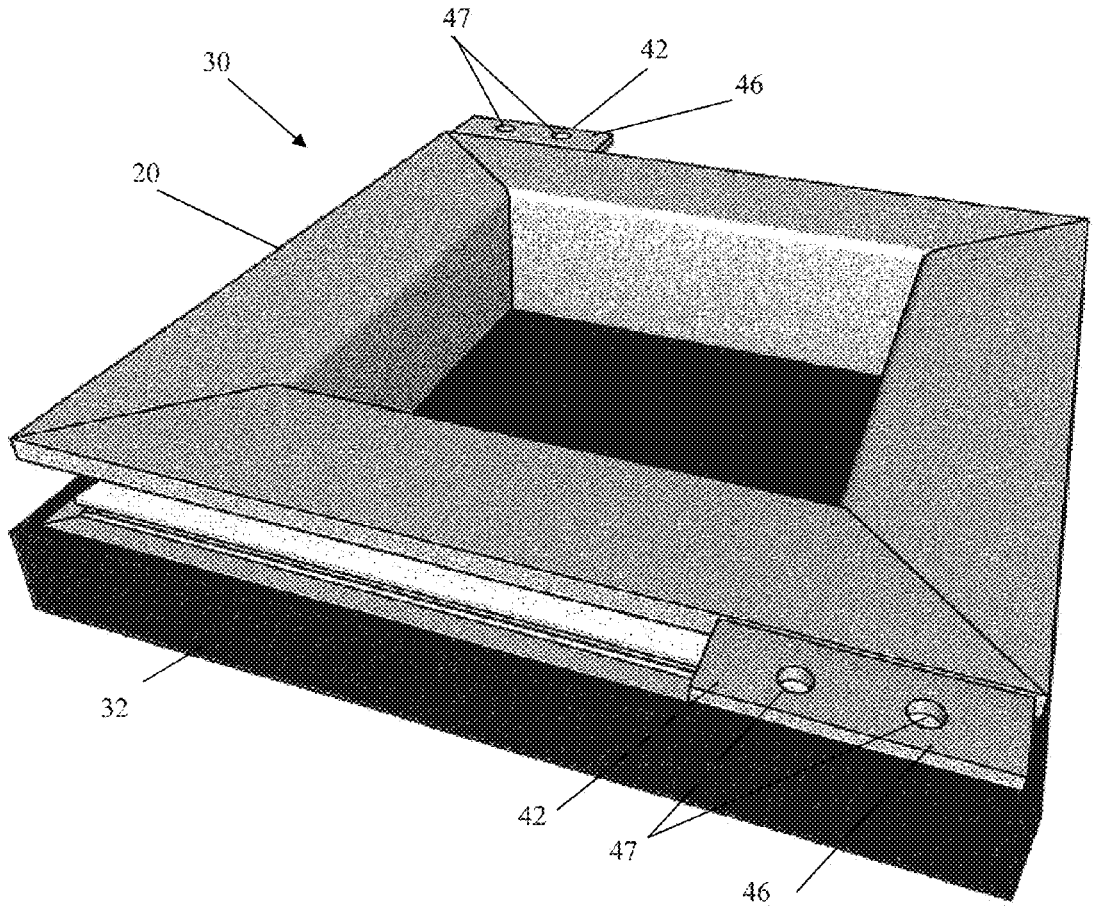
FIG. 6 is a rear perspective view of a preformed panel according to an embodiment of the present invention.

FIGS. 6, 7A and 7B, in particular, show the preformed panel (30) for use in the cladding assembly for cladding a structure. The preformed panel (30) includes: a frame (20) as described above; and a panel (32) operatively associated with the frame (20).

FIGS. 9A, 9B, 11A and 11B, in particular, show the cladding assembly (40) for cladding a structure. The cladding assembly (40) includes a plurality of the preformed panels (30) as described above.

Referring to FIG. 1, as mentioned above, the frame member (10) has at least four walls including an inner frame wall (11), an opposed outer frame wall (12), a panel abutting wall (13) and an opposed structure abutting wall (14) having a free end (15) with an outer edge protrusion (16).

The frame member (10) also has at least two ends (17), each end (17) defining a slot (18) and an opening (110) either of which can at least partially receive a joining component for joining the frame member (10) with other frame members depending on the form of joining component used.

Figure 2B:
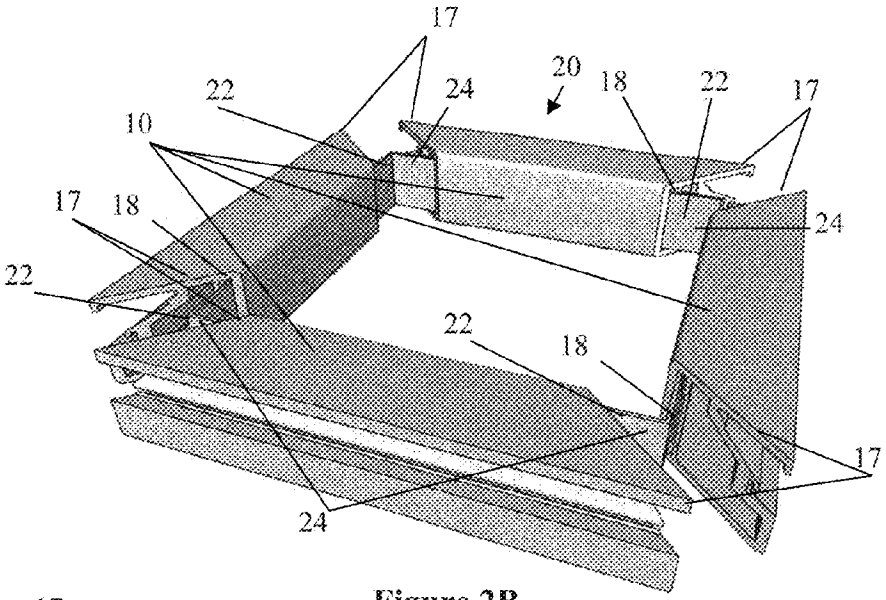
FIGS. 2A to 2C are perspective views of four frame members according to the embodiment shown in FIG. 1 being joined together with a joining component to form a frame.
Figure 3B:
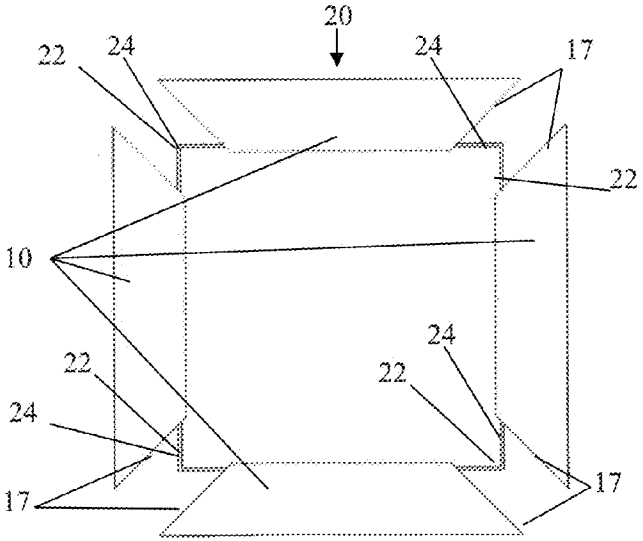
FIGS. 3A to 3C are front views of the frame members forming a frame as shown in FIGS. 2A to 2C.
Figure 3A:
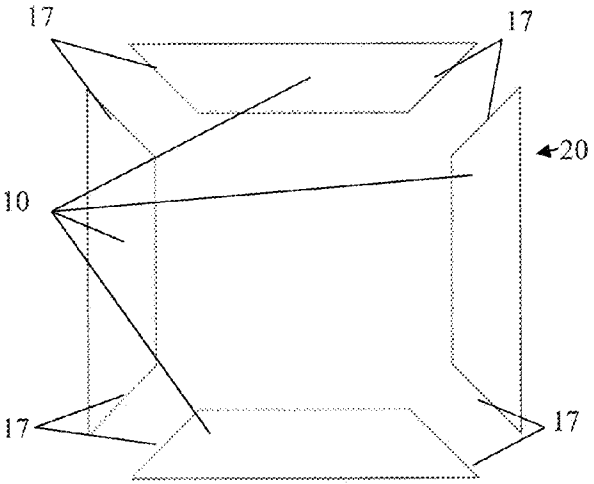
Figure 3C:
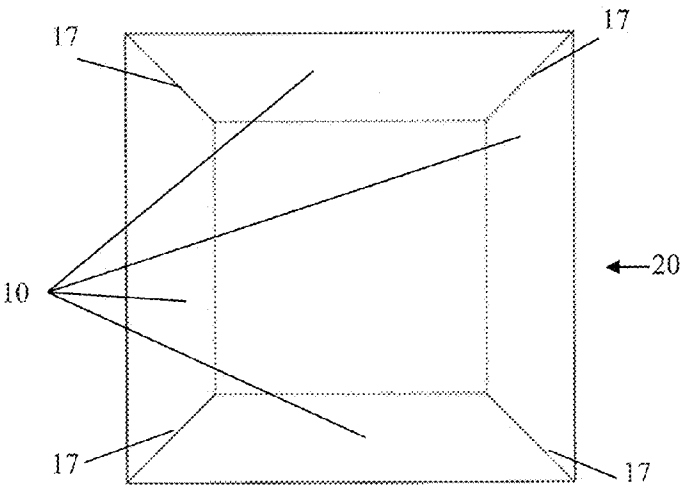
Figure 18A:
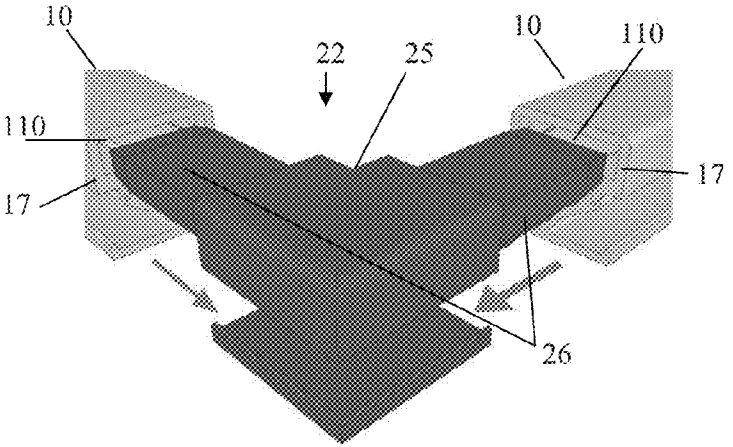
FIGS. 18A to 18D show the fitting of the corner connector as shown in FIGS. 17A and 17B to frame members.
Figure 18B:
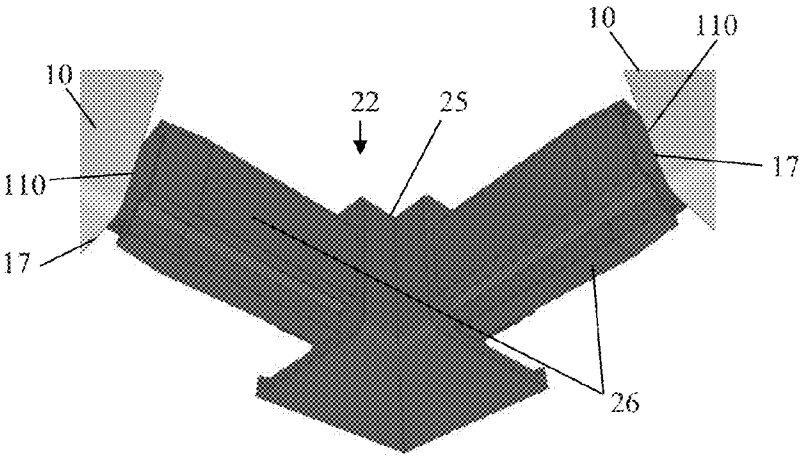
Figure 18C:
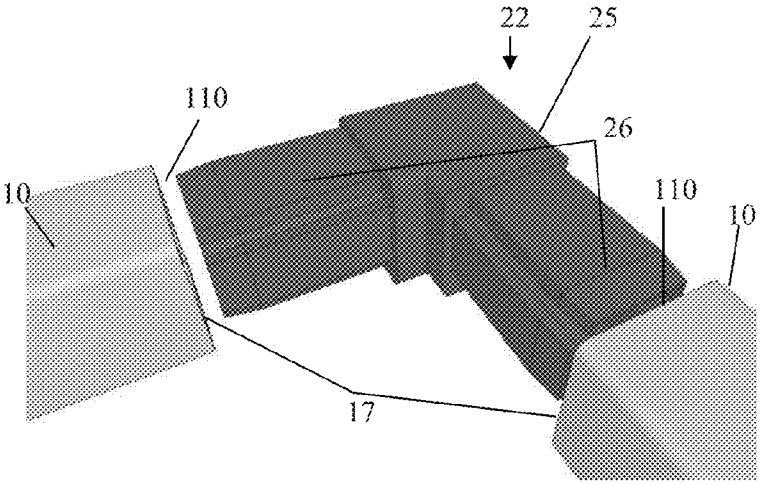
Figure 18D:
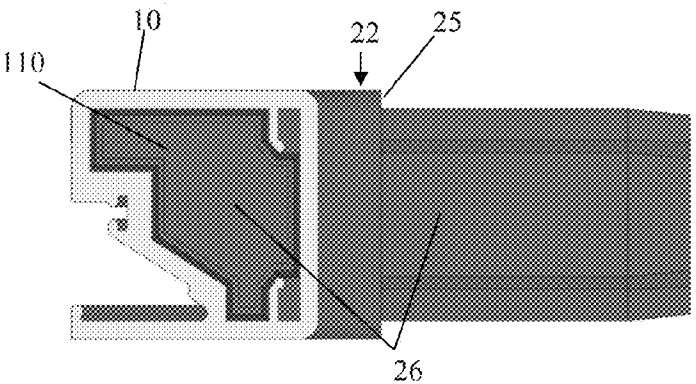
Figure 19:
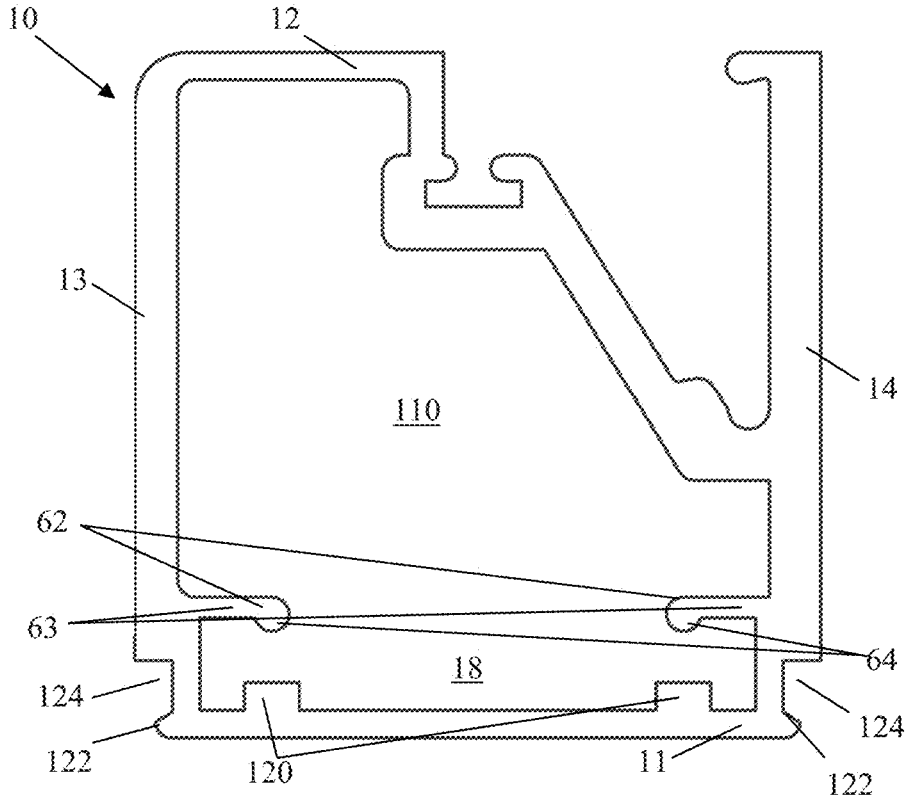
FIG. 19 is an end view of a frame member in accordance with an embodiment of the present invention.

In one embodiment, as shown in particular in FIGS. 2B and 3B, the joining component (22) is in the form of an elongate member (24) including two portions, each adapted to be at least partially received in a respective slot (18) defined in each end (17) of each frame member (10) to be joined. This joining component (22) is configured to be used with frame members (10) have profiled or mitred ends (17) for direct end (17) to end (17) joining In another embodiment, as shown in particular in FIGS. 17A, 17B and 18A to 18D, the joining component (22) is in the form of a corner connector (25) having a substantially L-shaped configuration and having first and second parts (26), each adapted to be at least partially received in one of the respective channels (110; best shown in FIG. 18D) defined at the ends (17) of the frame members (10) to be joined. The joining component (22) in this form as a corner connector (25) is for use with frame members (10) having square cut ends (17) for indirect end (17) to end (17) joining In yet another embodiment, as shown in particular in FIGS. 24A to 24D, the joining component (22) is in the form of a hinged connector (200) including two connector pieces (202; i.e., joining component pieces) that are hinged together for joining or connecting two frame members as shown in FIG. 19. Each connector piece (202) is attachable at or near the end of the frame member to be joined.

Figure 24B:
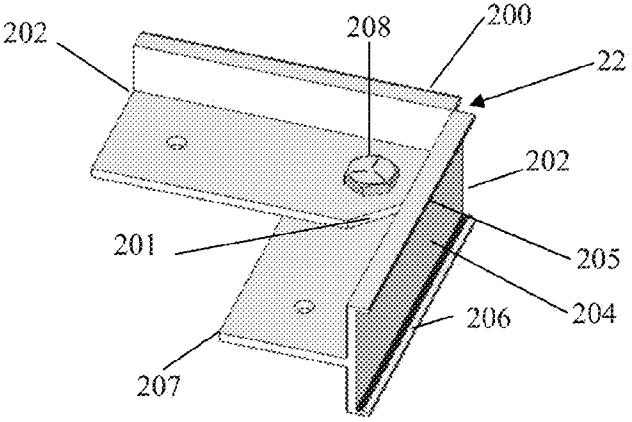
FIGS. 24A to 24D respectively show two perspective views of a joining component according to an embodiment of the present invention, an end view of a joining component piece of the joining component and an exploded view of the joining component.
Figure 24D:
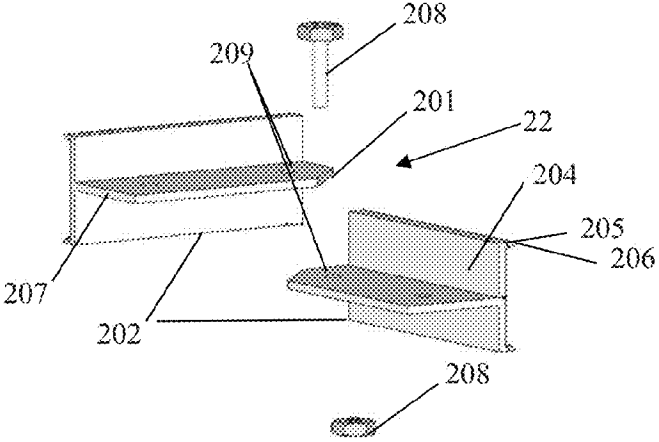
Figure 24A:
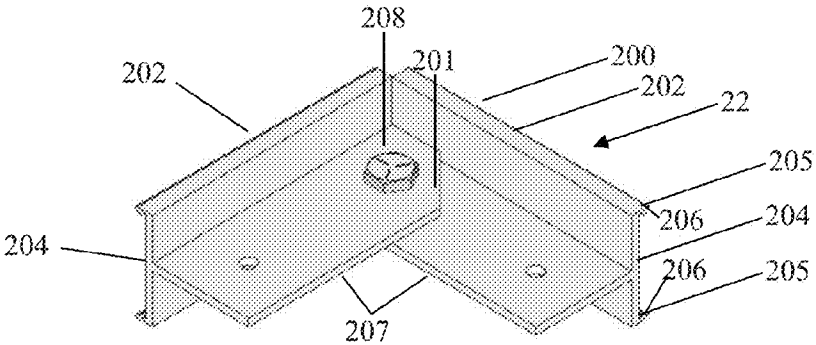
Figure 24C:
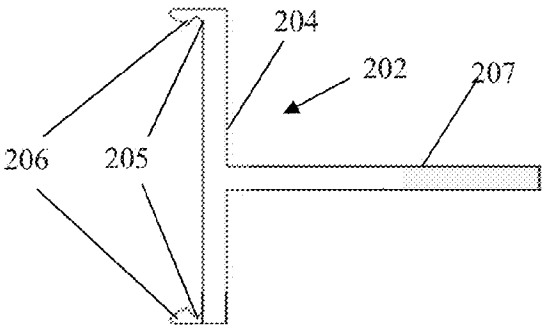

Best shown in FIG. 24C, each connector piece (202) is of unitary construction and has a substantially T-shaped cross section. Each connector piece (202) includes an elongate frame coupling member (204) having two projections (205) with enlarged end portions (206) extending outwardly from the outer longitudinal edges (206) of the frame coupling member (204) for clamping or hooking over protruding edges defined along the inner frame wall of the frame member. A hinge member (207) intersects and extends outwardly and intermediate the outer longitudinal edges (206) of the frame coupling member (204). In use and with reference to the frame member (10) shown in FIG. 19, the two projections (205) having enlarged end portions (206) hook over the protruding edges (122; see FIG. 19) and are received in the channels or grooves (124; see FIG. 19) defined in the adjacently positioned panel abutting wall (13; see FIG. 19) and structure abutting wall (14; see FIG. 19).

Referring to FIGS. 24A, 24B and 24D, the respective hinge members (207) from respective connector pieces (202) attached to the frame members to be joined are rotatably coupled together by way of a fastener (208) received in co-aligned apertures (209) defined by the respective hinge members (207). Each hinge member (207) includes a bevelled corner (201) to facilitate rotation between the hinged connector pieces (202). In this way, the join angle between two joined frame members may be readily adjusted by loosening the fastener (208), adjusting the angle between the two connector pieces (202) and tightening the fastener (208).

Turning back to FIG. 1, the slot (18) is defined by the inner frame wall (11), the panel abutting wall (13), the structure abutting wall (14) and two guiding members (62).

The guiding members (62) are two opposed projections (63) located near the inner frame wall (11) and extending inwardly from the panel abutting wall (13) and the structure abutting wall (14), respectively. Each projection (63) includes an end portion (64) angled toward the inner frame wall (11) for, in use, guiding an at least partially received portion of the joining component (not shown).

The channel (110) is defined by the panel abutting wall (13), the outer frame wall (12), the structure abutting wall (14), the two opposed projections (63) and the inner frame wall (11).

A receiving opening (19) is defined on the outer frame wall (12) between a portion of the outer frame wall (12) and the outer edge protrusion (16). The receiving opening (19) includes an angled wall (65) for, in use, positively positioning a frame member abutting portion of the tag against the inner surface (14*a*) of the structure abutting wall (14).

The receiving opening (19) is also suitably sized and shaped for receiving a joint strip and joint strip support, which, in use, are positioned between adjacently positioned preformed panels or other cladding systems and the like. The joint strip and/or joint strip support are positioned within the receiving opening (19) to at least partially cover the one or more tags.

Figure 2A:
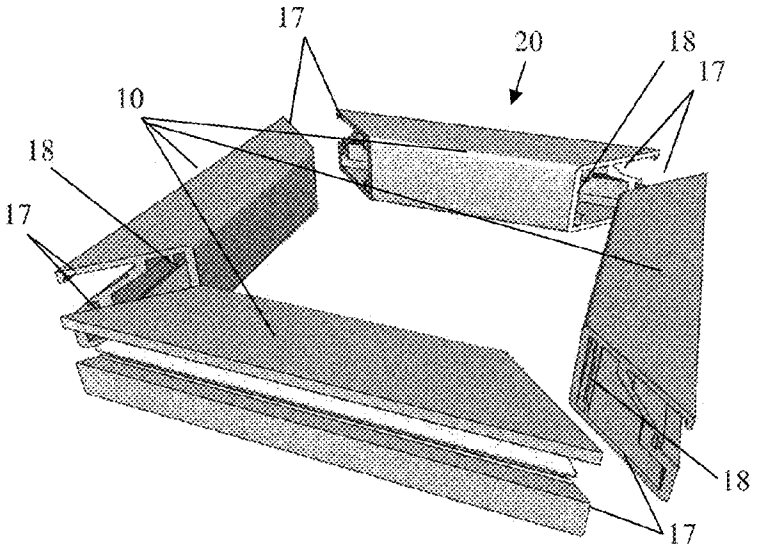
Figure 2C:
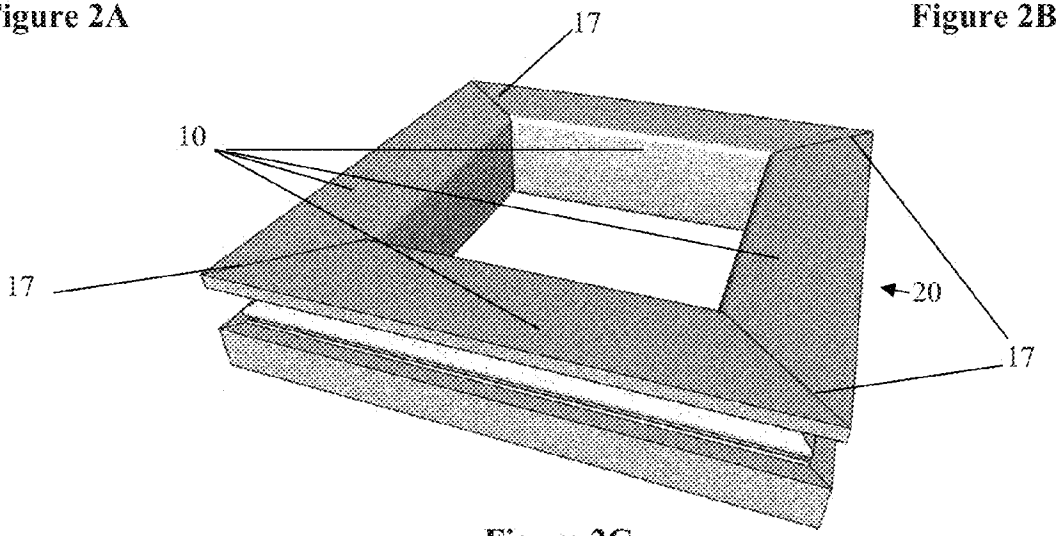
Figure 4A:
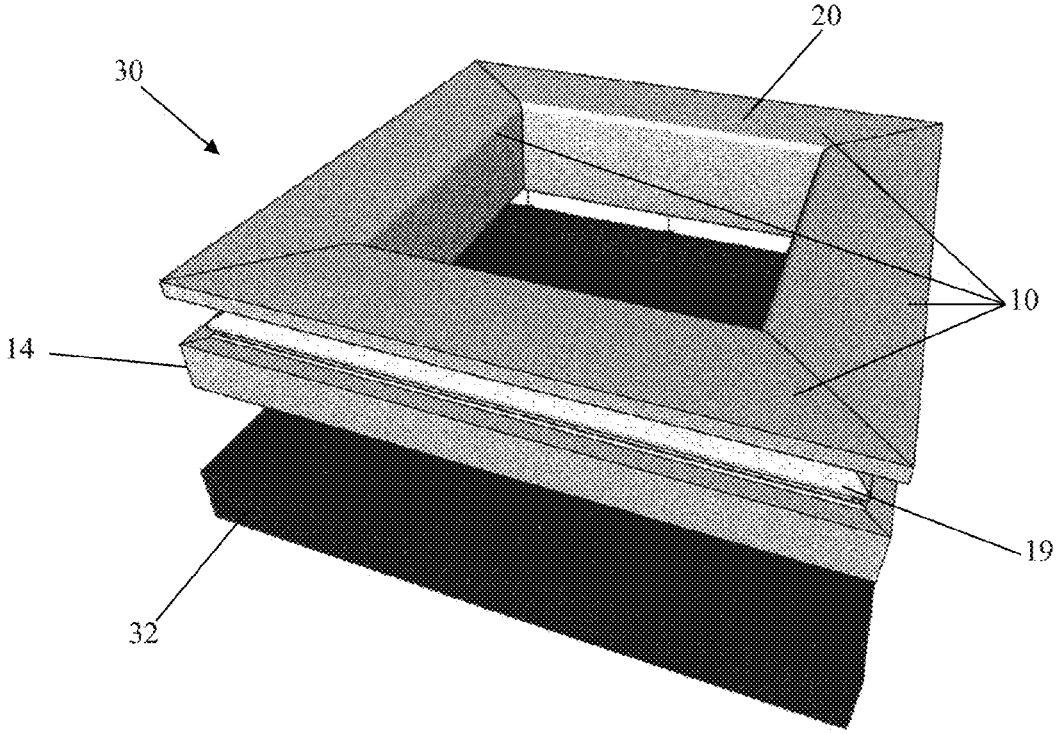
FIGS. 4A and 4B show the frame shown in FIGS. 2A to 2C and 3A to 3C being fitted to a panel.
Figure 4B:
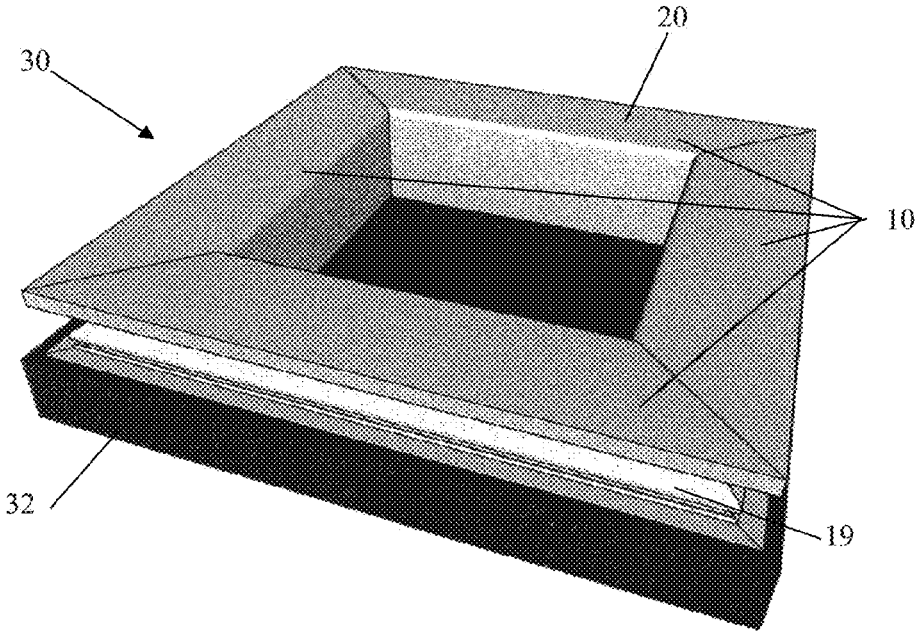

Referring to FIGS. 4A and 4B, the preformed panel (30) includes the frame (20) shown in FIGS. 2A to 2C fitted to a panel (32). The panel (32) is fitted over the panel abutting walls of the frame members (10) forming the frame (20) and also covers a portion of the outer frame walls (14) of each frame member (10). However, best seen in FIG. 4B, the panel (32) does not cover the receiving opening (19).

Figure 5A:
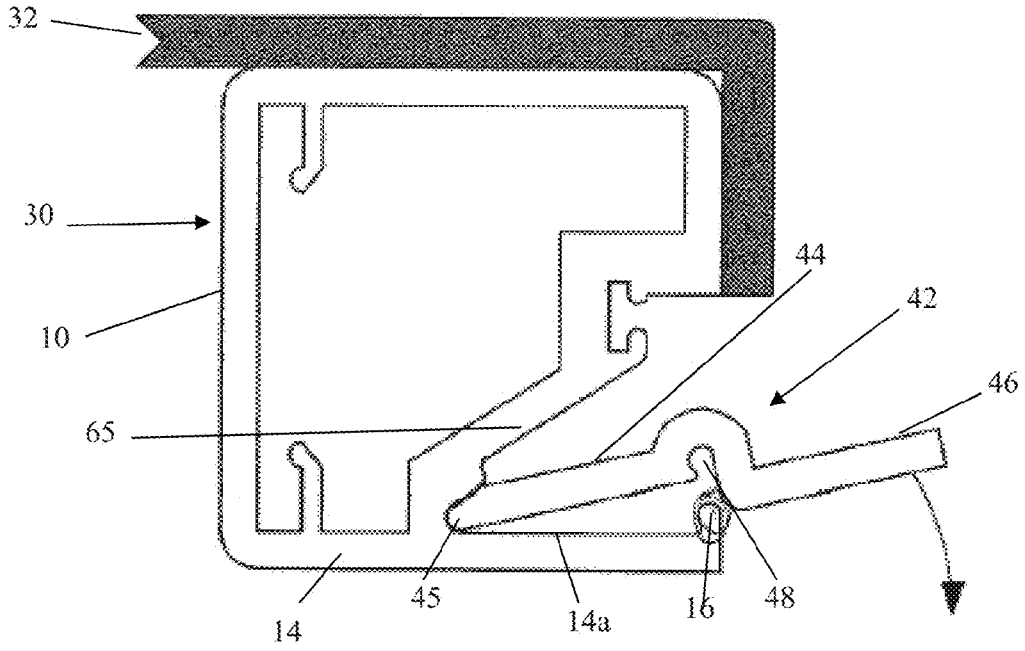
FIGS. 5A and 5B show a fastener being attached to the frame member shown in FIG. 1.
Figure 5B:
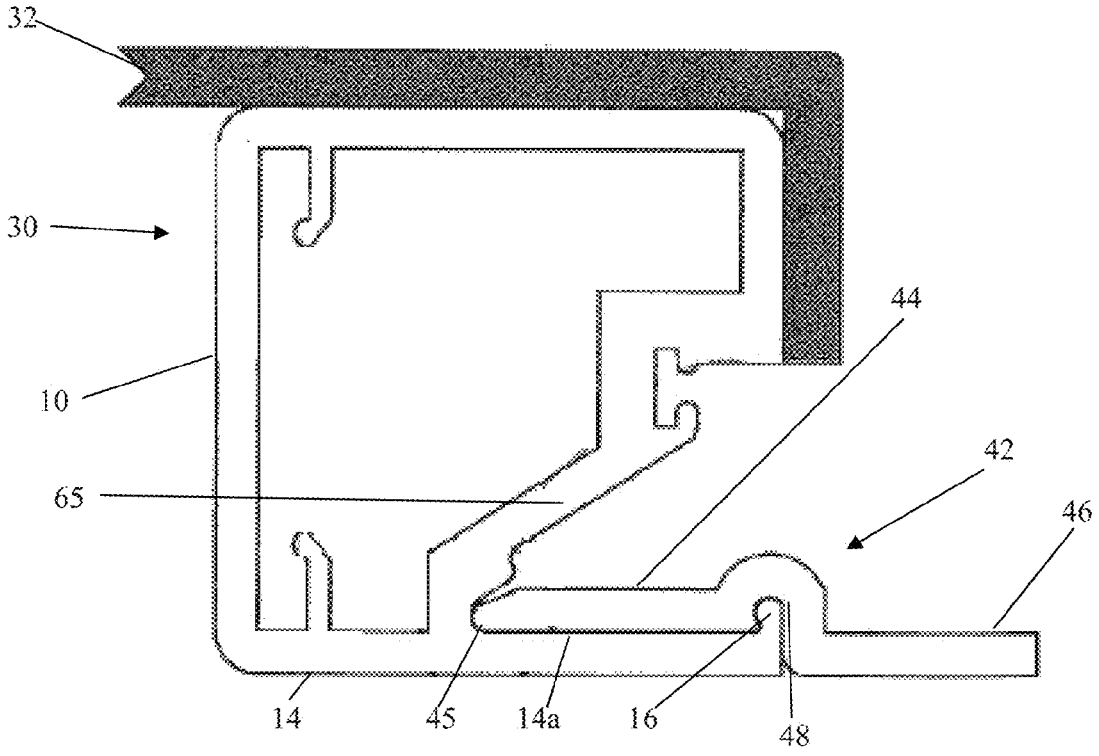

FIGS. 5A and 5B show a tag (42) being fitted to the preformed panel (30), which is carried out on site prior to installing the preformed panel (30) to a structure.

The tag (42) is a substantially planar member with a frame member abutting portion (44), a structure abutting portion (46) and a shaped groove (48) defined in between. The shaped groove (48) is, in use, and as best shown in FIG. 5B, adapted to receive and engage the outer edge protrusion (16) of the frame member (10).

During installation, the angled wall (65) of the receiving opening (19) positively positions the leading edge (45) of the frame abutting portion (44) of the tag (42) against the inner surface (14*a*) of the structure abutting wall (14) of the frame member (10). Once correctly positioned, the installer then snap-fits the tag (42) into position such that the outer edge protrusion (16) is snap-fitted in to the shaped groove (48).

The angled wall (65) and the snap-fit of the outer edge protrusion (16) into the shaped groove (48) provide both tactile and audible feedback to the installer when attaching the tag (42) to the preformed panel (30). Both the tactile and audible feedback allow an installer to attach the tag (42) without necessarily relying on visual cues.

Best shown in FIG. 5B, the tag (42) when attached extends from the edge of the frame member (10) to which it is attached in most instances lies substantially in plane with the structure abutting wall (14) of the frame member (10).

Figure 20A:
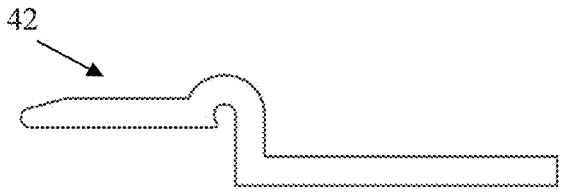
FIGS. 20A and 20B respectively show side views of a tag according to an embodiment of the present invention for attaching a frame member to a structure or building and the tag associated with the frame member as shown in FIG. 19.
Figure 20B:
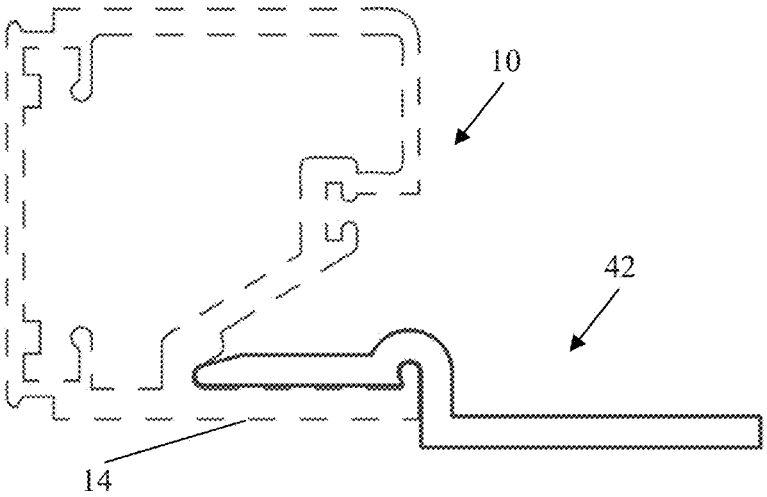

Referring to FIGS. 20A and 20B and best shown in FIG. 20B, in some instances, it may be desirable that the tag (42), when attached and extending from the edge of the frame member (10), does not lie in plane the structure abutting wall (14) of the frame member (10). This may be advantageous when, for example, co-fastening tags from adjacent preformed panels one atop the other to the structure or building with the same threaded or mechanical fastener or the like.

FIG. 6 and FIGS. 7A and 7B show the preformed panel (30), including the frame (20) fitted to the panel (32). The preformed panel (30) is ready to be fastened to a structure having two tags (42) attached to substantially opposed sides of the frame (20). The attached tags (42) have two apertures (47) defined in the structure abutting portion (46) of each tag (42). Each aperture (47) is sized and shaped to receive a threaded fastener, mechanical fastener or the like for fastening the tag (42) to a structure.

Figure 8A:
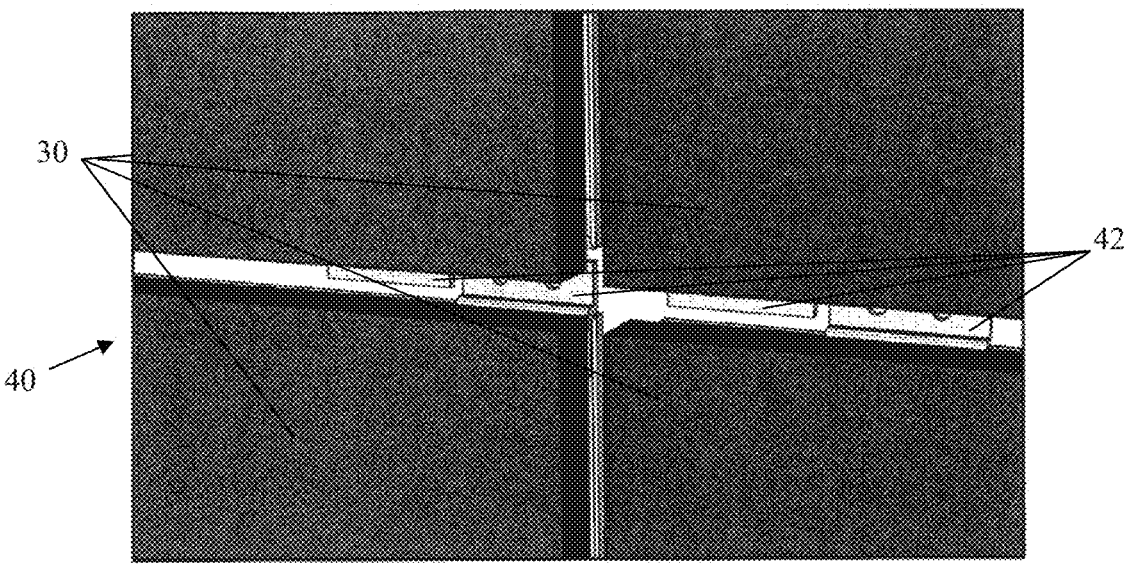
FIGS. 8A and 8B respectively show a perspective view and a front view of a cladding assembly according to an embodiment of the present invention.
Figure 8B:
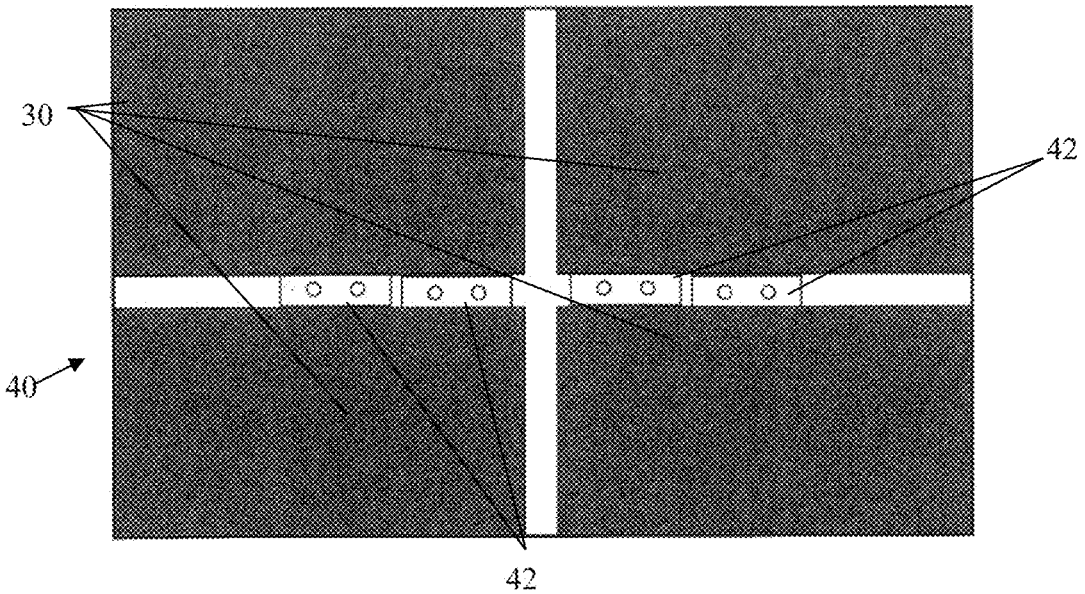

FIGS. 8A and 8B show the preformed panels (30) arranged in a cladding assembly (40). As best seen in FIG. 8B, the respective tags (42) from each preformed panel (30) are aligned for fastening to a structure.

Figure 9A:
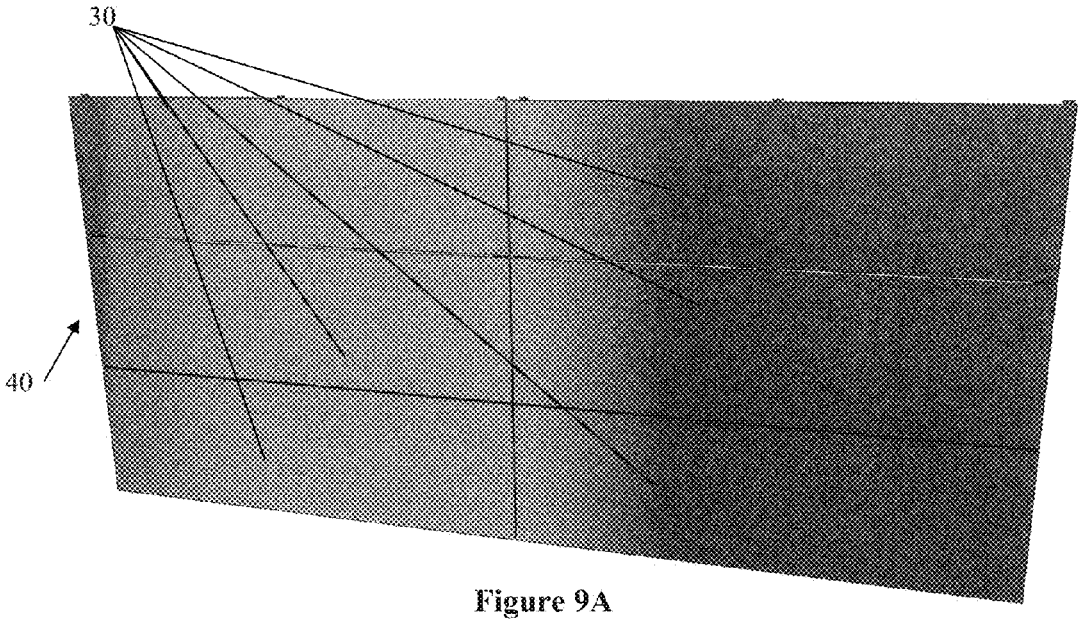
FIGS. 9A and 9B respectively show a perspective view and a front view of a cladding assembly according to another embodiment of the present invention.
Figure 9B:
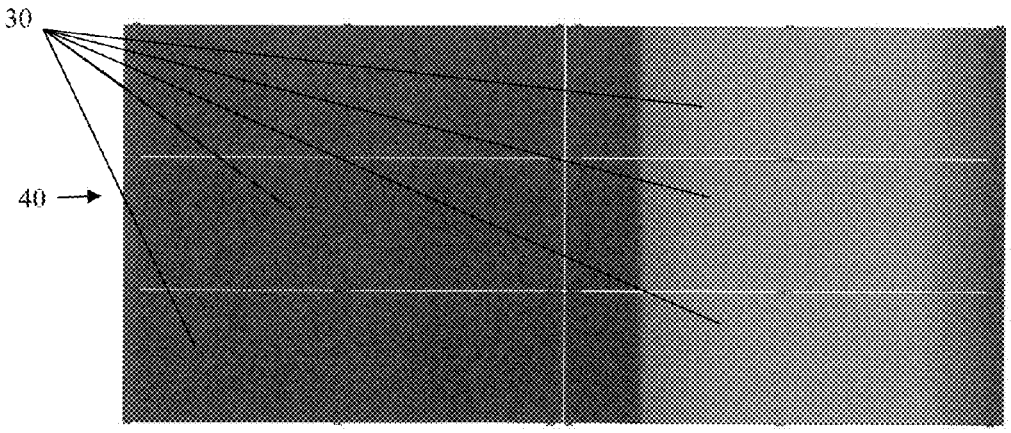

FIGS. 9A and 9B show preformed panels (30) arranged in a cladding assembly (40) prior to the installation of a joint strip and joint strip support between the arrayed preformed panels (30).

FIGS. 10A to 10E show the process of installing a joint strip (75) between adjacently arranged preformed panels (30) of a cladding assembly (40). An installer would install the joint strip (75) once the adjacently positioned preformed panels (30) are fastened to a structure.

Figure 10A:
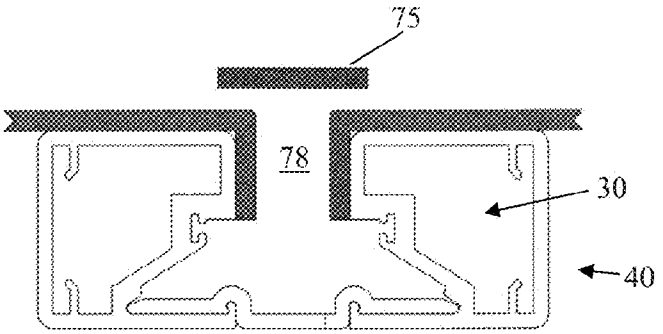
FIGS. 10A to 10E show the process for installing a joint strip between adjacent preformed panels of the cladding assembly shown in FIGS. 9A and 9B.

Best shown in FIG. 10A, each joint strip (75) is aligned with the gap (78) between the preformed panels (30).

Figure 10B:
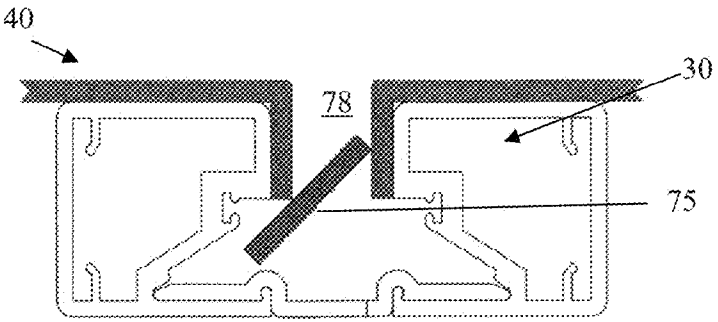
Figure 10C:
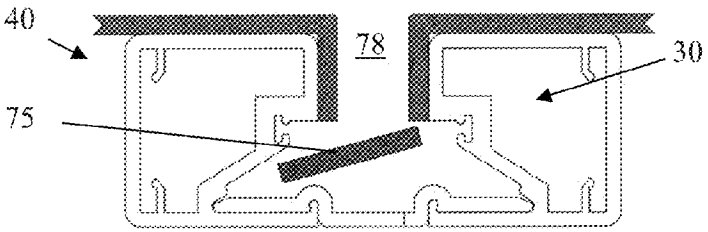

Referring to FIGS. 10B and 10C, the joint strip (75) is then angled so that the joint strip (75) can pass between the adjacently positioned preformed panels (30).

Figure 10D:
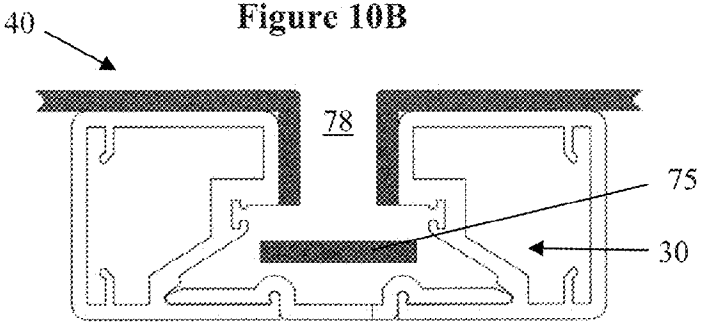

Referring to FIG. 10D, the joint strip (75) is then re-aligned so that the joint strip (75) at least partially covers the underlying tags (42).

Figure 10E:
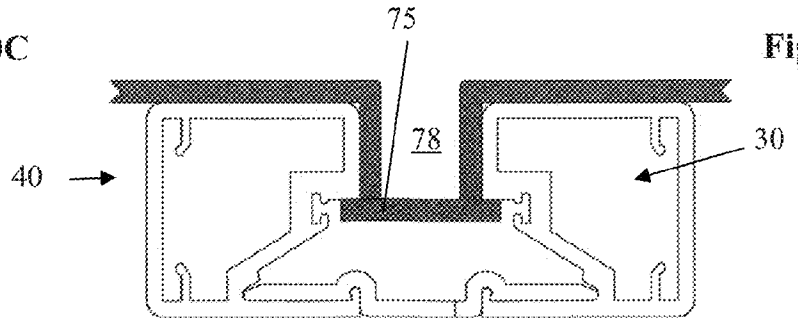

As shown in FIG. 10E, the joint strip (75) is then positioned flush with the edges of the panels (32) from the adjacently positioned preformed panels (30) by inserting the joint strip support, which is positioned between the joint strip (75) and the underlying tags (42).

Figure 11A:
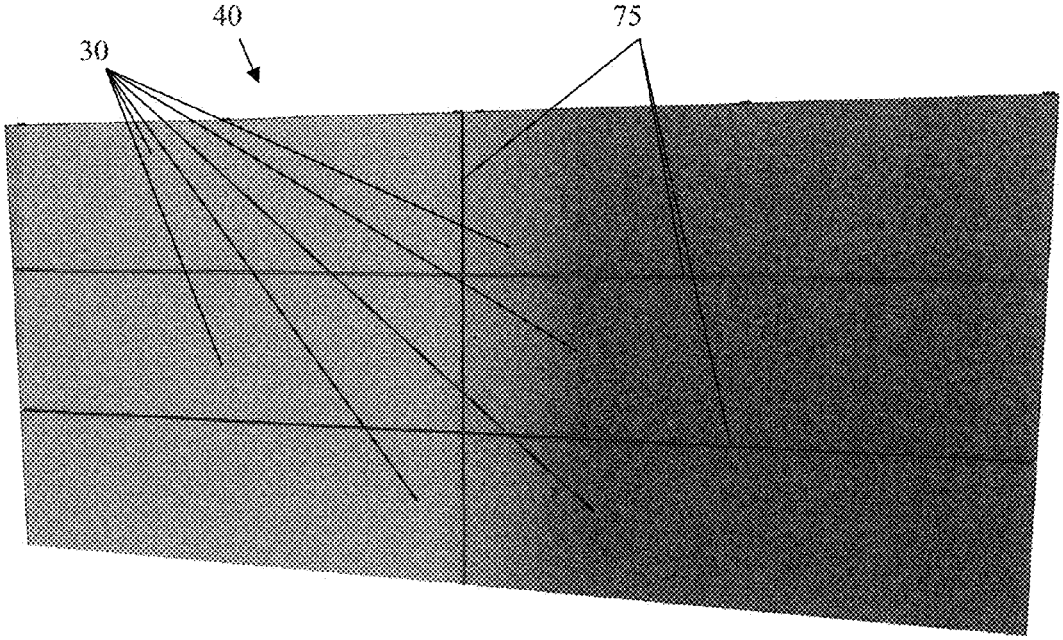
FIGS. 11A and 11B respectively show a perspective view and a front view of the cladding assembly shown in FIGS. 9A and 9B with joint strips installed between the preformed panels.
Figure 11B:
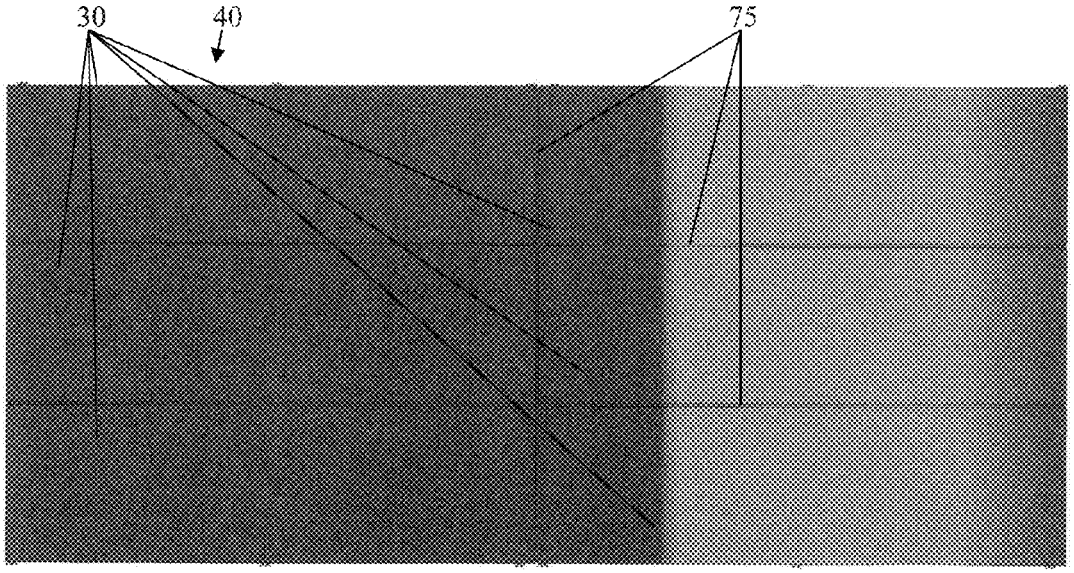

FIGS. 11A and 11B show the cladding assembly (40) shown in FIGS. 9A and 9B after the joint strip (75) and joint strip support have been installed.

Figure 12:
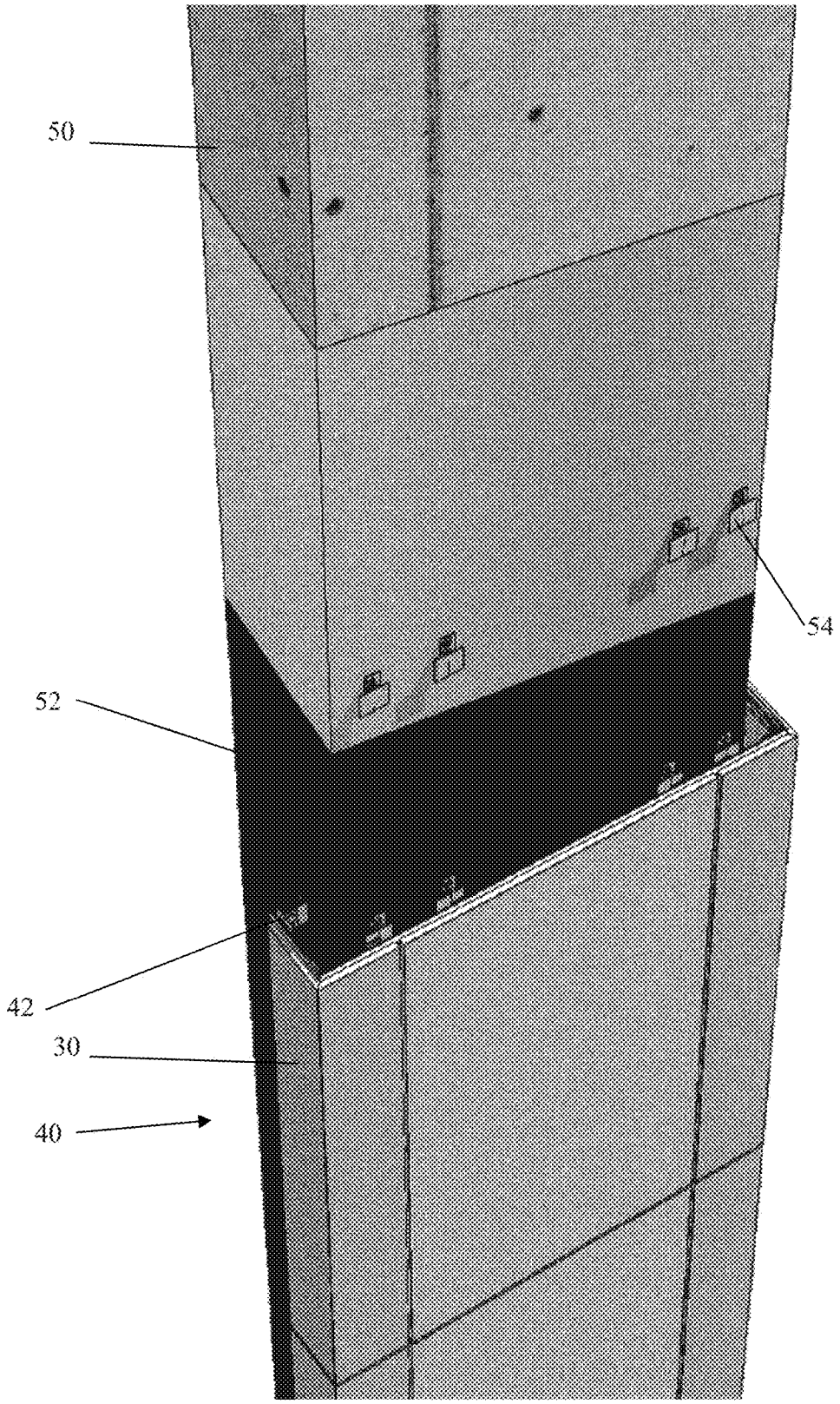
FIG. 12 is an elevated perspective view showing the installation of the cladding assembly according to an embodiment of the present invention being installed onto a column.
Figure 13:
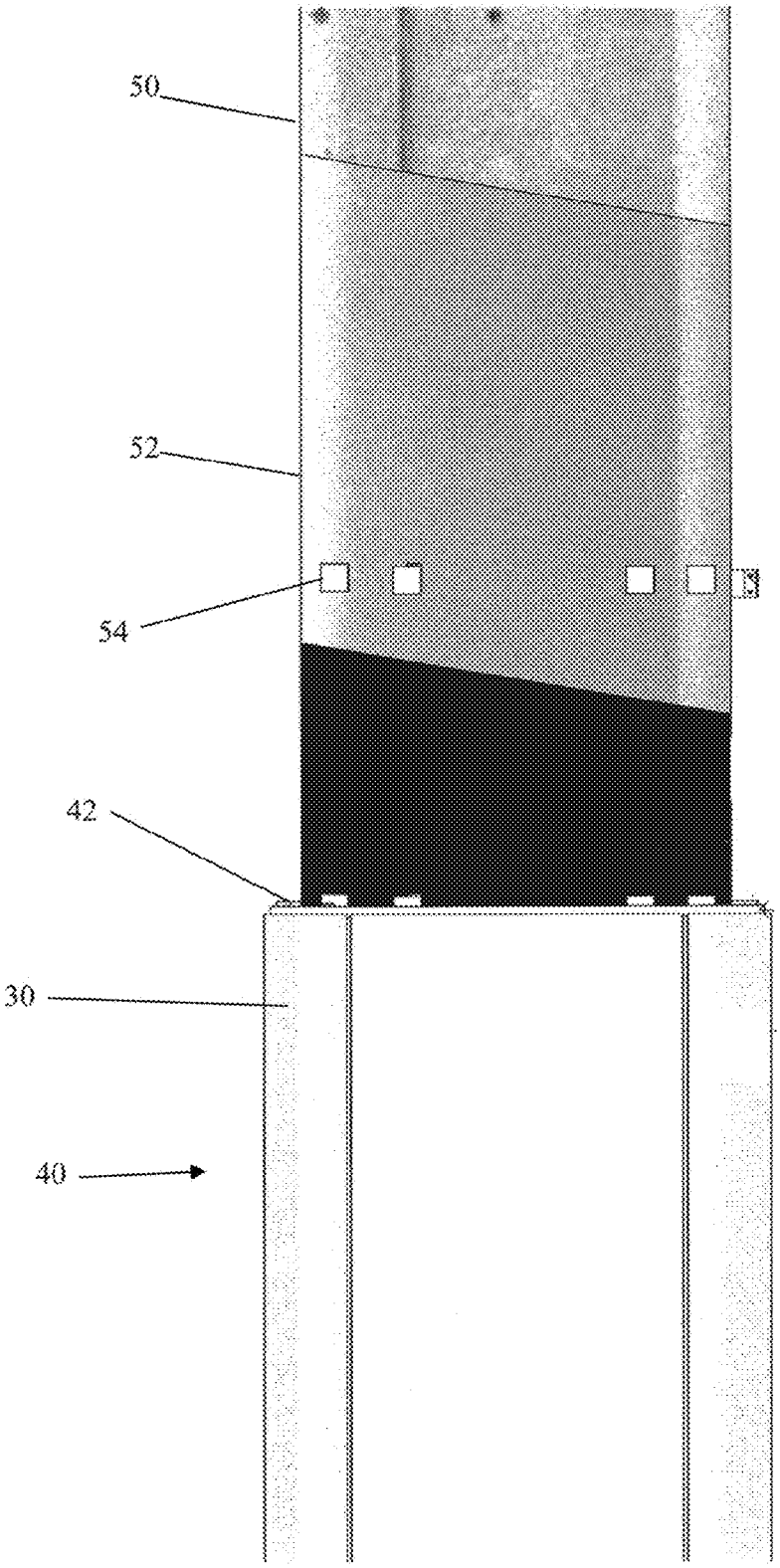
FIG. 13 is a front view showing the installation of the cladding assembly as shown in FIG. 12.
Figure 14:
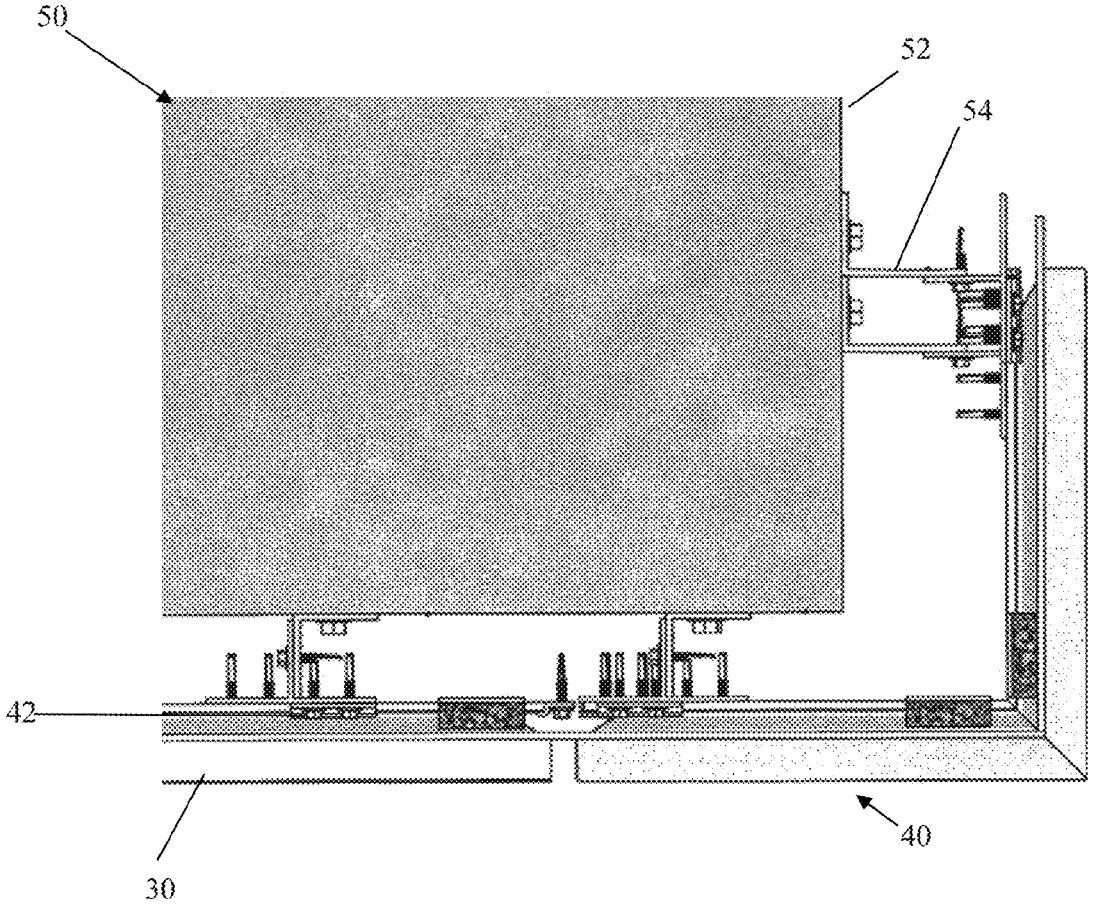
FIG. 14 is an end view of FIG. 13.

FIGS. 12 to 14 show a cladding assembly (40) of the present invention being installed on a structure (50). In the embodiment shown, the cladding assembly (40) is not directly installed to the wall (52) of the structure (50) but instead the tags (42) from each preformed panel (30) are fastened to a structural support bracket (54).

Figure 15B:
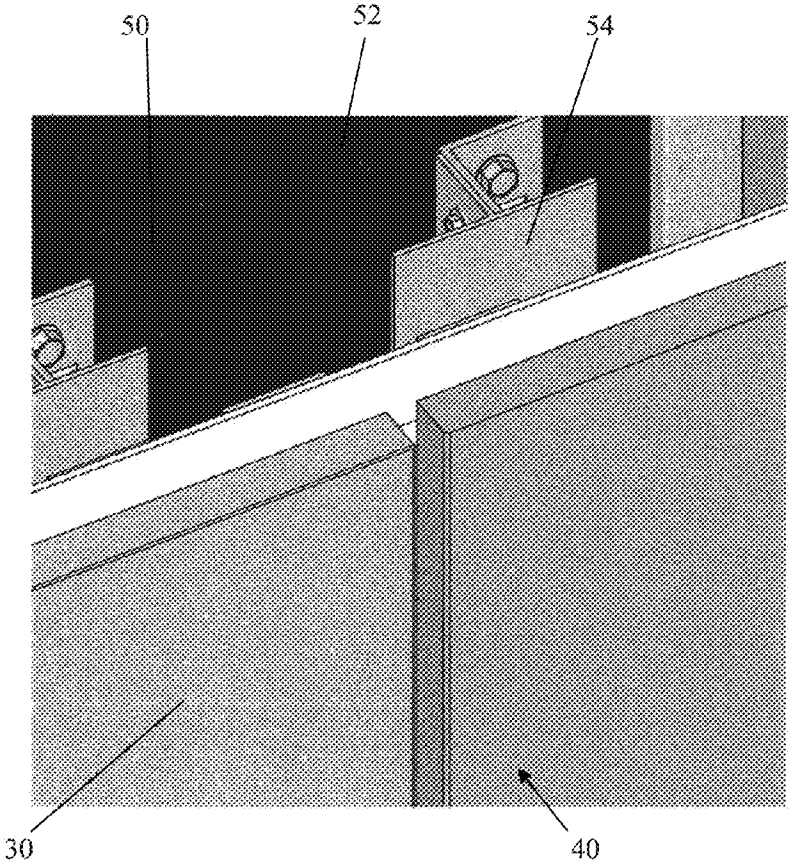
FIGS. 15A and 15B respectively show an end view and a perspective view of a join between two adjacently positioned performed panels according to an embodiment of the present invention.
Figure 15A:
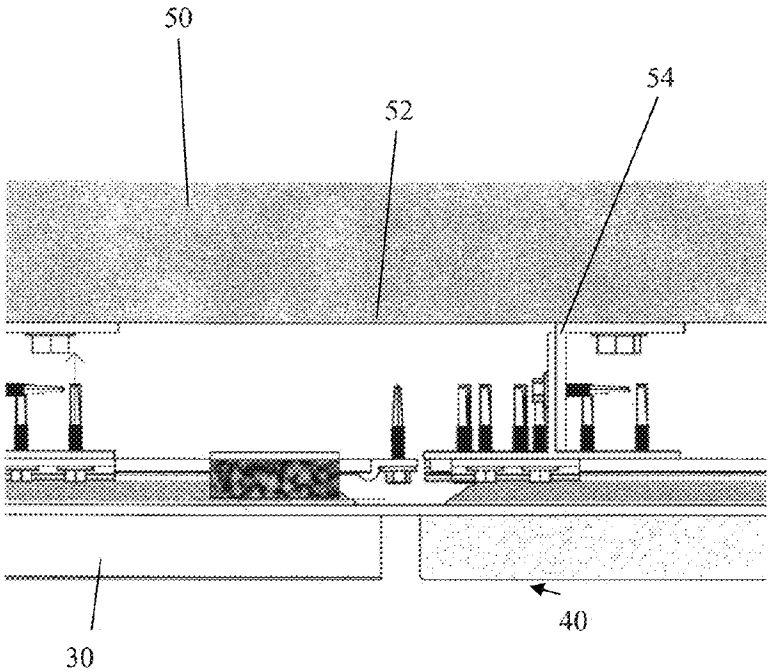

FIGS. 15A and 15B show a vertical join between two preformed panels (30) of the cladding assembly (40) shown in FIGS. 12 to 14. Best shown in FIG. 15B, the tags (42) of the preformed panels (30) are fastened indirectly to the structural support bracket (54) rather than directly to the structure (50).

Figure 16B:
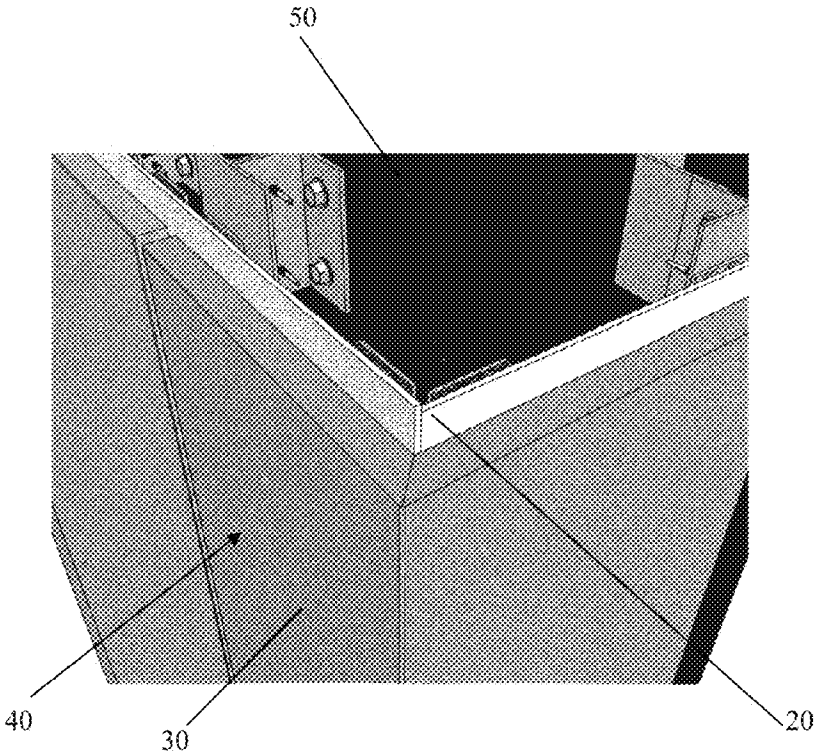
FIGS. 16A and 16B respectively show an end view and a perspective view of a mitred corner join between two adjacently positioned preformed panels according to an embodiment of the present invention.
Figure 16A:
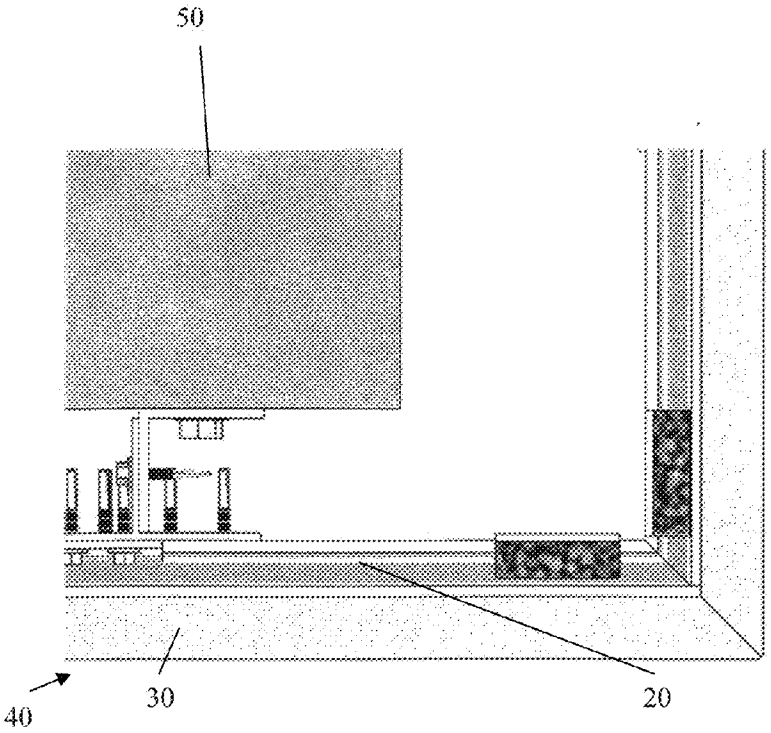
Figure 17B:
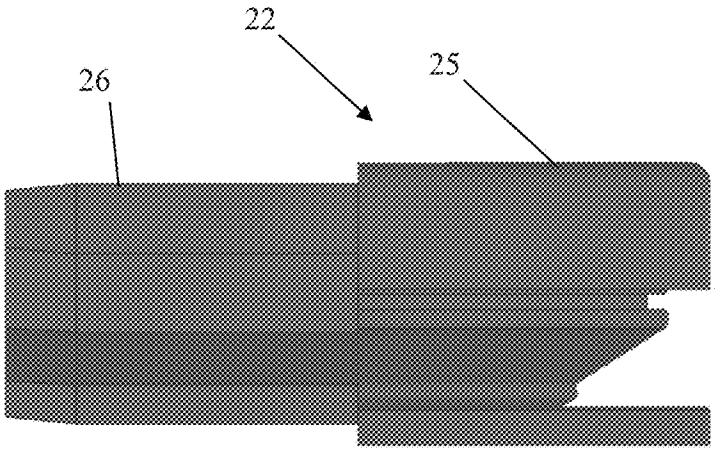
FIGS. 17A and 17B respectively show a top view and a side view of a corner connector in accordance with an embodiment of the present invention.
Figure 17A:
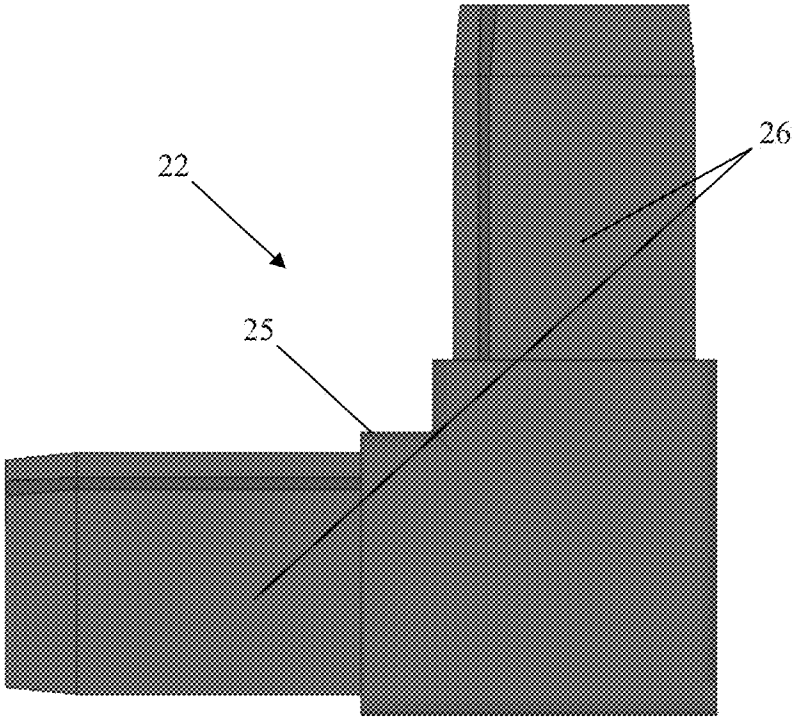

FIGS. 16A and 16B show a corner join between two preformed panels (30) of the cladding assembly (40) shown in FIGS. 12 to 14. The panel (32) and underlying frame (20) of the adjacent preformed panels (30) forming the corner joint have mitred adjacent edges to form a flush corner joint.

Referring to FIG. 19, in one embodiment, the frame member (10) further includes two positioning members (120) located within the slot (18) opposite the guiding members (64) for guiding, positioning and receiving a portion of the joining component (22) at least partially received in either the slot (18) or channel (110). The two positioning members (120) extend inwardly from the inner frame wall (11) towards the guiding members (64).

With reference to FIG. 19, in one embodiment, the frame member (10) further includes an inner frame wall (11) with protruding edges (122; i.e., shoulders) at least partially defined by channels or grooves (124) defined in the adjacently positioned panel abutting wall (13) and structure abutting wall (14).

Figure 21:
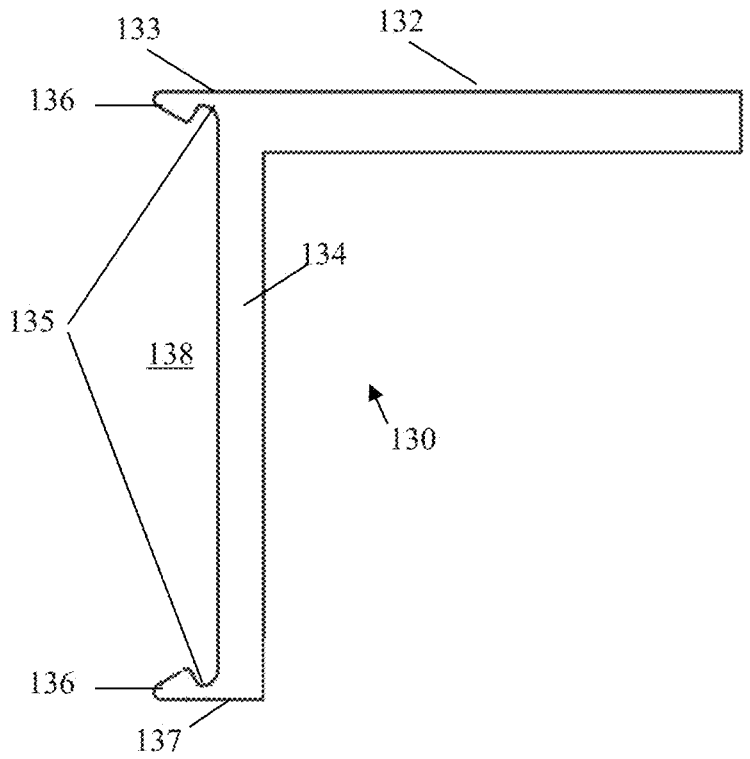
FIG. 21 is a side view of a coupler for coupling the frame member as shown in FIG. 19 to a panel.
Figure 22:
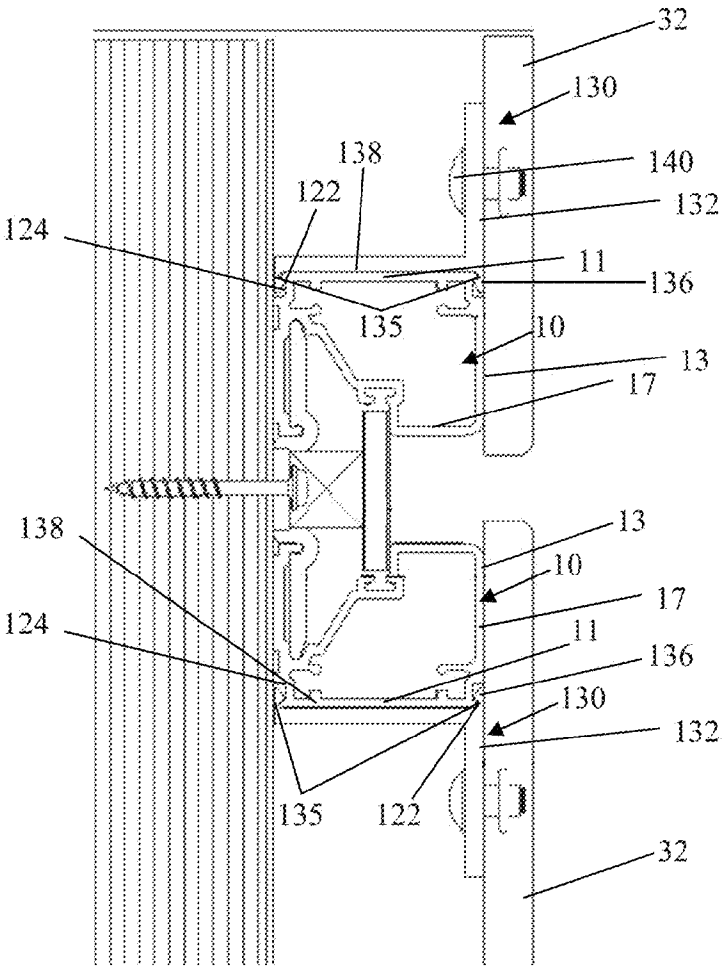
FIG. 22 is a sectional side view showing the use of the coupler shown in FIG. 21 to fasten panels to frames formed from the frame member shown in FIG. 19.

Referring to FIGS. 21 and 22, the embodiment of the frame member (10) shown in FIG. 19 is sized and shaped to couple with the coupler (130) shown in FIG. 21.

With reference to FIG. 21, the coupler (130) is of unitary construction and has a substantially L-shaped cross section having a panel abutting member (132) and a frame member coupling member (134) extending substantially perpendicular to the panel abutting member (132) from a common or shared edge (133) of the panel abutting member (132). The frame member coupling member (134) further defines two projections (135) with enlarged end portions (136) extending outwardly from the common or shared edge (133) and an opposed outer edge (137) of the frame coupling member (134). The two projections (135) define a channel or groove (138) sized and shaped to couple with the inner frame wall (11) of the frame member (10) shown in FIG. 19.

Referring to FIG. 22, the coupler (130) is in use slid over an end (17) of the frame member (10) as shown in FIG. 19 and coupled to the inner frame wall (11) of the frame member (10) such that the panel abutting member (132) of the coupler (130) is substantially planar with the panel abutting wall (13) of the frame member (10). The inner frame wall (11) is sized and shaped to be at least partially received in the channel or groove (138) of the coupler (130) with the two projections (135) having enlarged end portions (136) hooking over the outer edges (122) of the inner frame wall (11). The enlarged end portions (136) are received in the channels or grooves (124) defined in the adjacently positioned panel abutting wall (13) and structure abutting wall (14).

Once coupled to the frame member (10), the panel abutting member (132) is fastened to the panel (32) with one or more threaded or mechanical fasteners (140).

Figure 23:
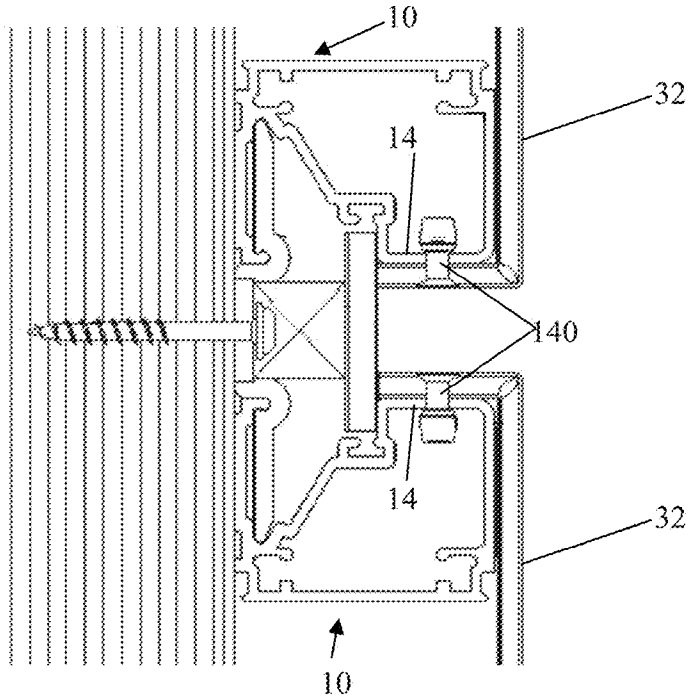
FIG. 23 is a sectional side view of panels fastened to frames as shown in FIG. 22 but without the use of the coupler.

Referring to FIG. 23, the panel (32) can alternatively be directly fastened to a frame member (10) by one or more threaded or mechanical fasteners (140), which pass through the panel (32) and the outer frame wall (14) of the frame member (10).

Figure 25B:
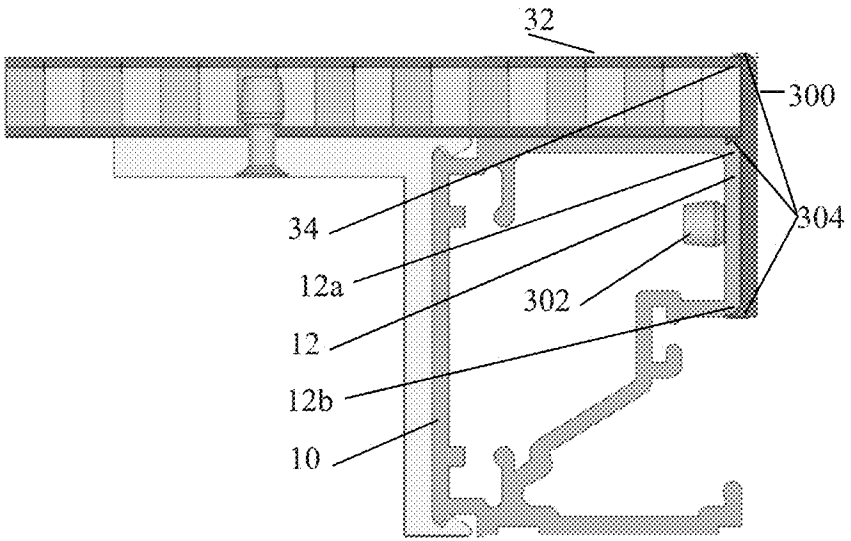
FIGS. 25A and 25B respectively show a perspective view and a sectional end view of the use of an edge cover according to an embodiment of the present invention.
Figure 25A:
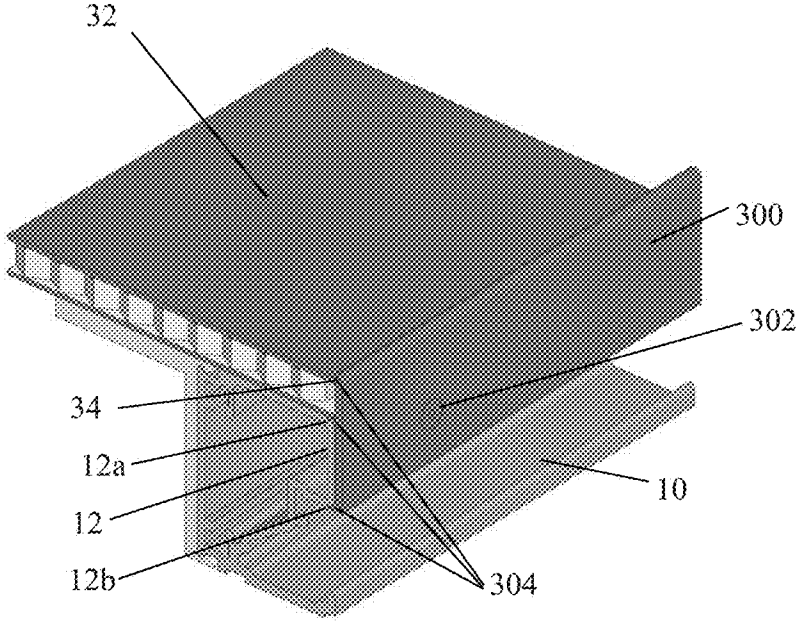

FIGS. 25A and 25B show an edge cover (300) for an outer edge (34) of the panel (32). The edge cover (300) includes threes hooks or clips (304) that respectively hook or clip over the outer edge (34) of the panel (32) and an outer edge (12*a*) and inner edge (12*b*) of the outer frame wall (12) of a frame member (20) of the frame (10). The edge cover (300) can be further fastened to the outer frame wall (12) of the frame member (10) by a fastener (302).

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A frame member adapted to be joined together with at least one other frame member to form a frame of a preformed panel, said frame member comprising:

at least four walls comprising:

an inner frame wall;

an opposed outer frame wall;

a panel abutting wall; and an opposed structure abutting wall having a free end extending away from the inner frame wall, the free end comprising an outer edge protrusion; and at least two ends, each end defining an opening comprising an enclosed space defined by the at least four walls, wherein the opening comprises a slot defined by the inner frame wall, a portion of the panel abutting wall, a portion of the structure abutting wall and at least two opposed projections extending inwardly from the panel abutting wall and the structure abutting wall, respectively, wherein the slot is adapted to at least partially receive a joining component for joining the frame member with the at least one other frame member to form the frame and wherein one or more guiding members extend from the at least two projections for guiding a portion of the joining component at least partially received within the slot, wherein the one or more guiding members each comprise an end portion angled towards the inner frame wall, and wherein a receiving opening is defined between a portion of the outer frame wall and the outer edge protrusion for receiving one or more fasteners which engage the outer edge protrusion for, in use, fastening the frame member and thereby the frame of the preformed panel to a structure.

2. The frame member of claim 1, wherein the outer edge protrusion has at least two portions of differing diameters for engaging the one or more fasteners to snap-fit over the outer edge protrusion.

3. The frame member of claim 1, further comprising one or more positioning members located within the slot opposite the one or more guiding members, wherein the one or more positioning members together with the one or more guiding members are adapted to guide, position and receive the portion of the joining component at least partially received within the slot.

4. The frame member of claim 3, wherein the one or more guiding members together with the one or more positioning members are adapted to snugly receive the portion of the joining component at least partially received in the slot to, in use, at least frictionally engage or secure the portion between the one or more guiding members and the one or more positioning members.

5. A frame of a preformed panel for use in a cladding assembly for cladding a structure, said frame comprising:

at least two frame members each as defined in claim 1 joined together to form the frame; and at least two joining components, each joining component at least partially received by a first of said frame members and a second of said frame members for joining the first of said frame members with the second of said frame members, wherein each frame member defines the receiving opening for at least partially receiving one or more fasteners for fastening the frame member and thereby, in use, the frame of the preformed panel to the structure.

6. The frame of claim 5, wherein the at least two frame members have mitred ends adapted to be connected or joined directly to each other via at least one of the joining components.

7. The frame of claim 5, wherein each of the joining components is an elongate member including two portions, each portion adapted to be at least partially received within the slot defined in the end of each of the at least two frame members to be joined.

8. The frame of claim 5, wherein each of the joining components is substantially L-shaped.

9. The frame of claim 5, wherein, when the at least two frame members are joined together, each of the joining components is not visible.

10. The frame of claim 5, wherein the at least two frame members have square cut ends and each of the joining components is a corner connector having a first part adapted to be at least partially received in the end of the first of said frame members and a second part adapted to be at least partially received in the end of the second of said frame members to be joined or connected to the first of said frame members.

11. The frame of claim 10, wherein each end of the frame members to be joined defines the opening adapted to snugly receive one of the first part and the second part of the corner connector.

12. The frame of claim 11, wherein the one of the first part and the second part of the corner connector is frictionally fitted into the opening.

13. A preformed panel for use in a cladding assembly for cladding a structure, the performed panel comprising:

the frame as defined in claim 5;

each joining component is at least partially received by the first of said frame members and the second of said frame members for joining the first of said frame members with the second of said frame members to form the frame; and a panel operatively associated with the frame, wherein each frame member defines the receiving opening for at least partially receiving one or more fasteners for fastening the frame member and thereby the frame of the preformed panel to the structure.

14. The preformed panel of claim 13, wherein the panel is operatively associated with the frame by being at least partially fitted over the frame and fastened in place.

15. The preformed panel of claim 13, wherein the panel is operatively associated with the frame by being fastened to the frame with one or more couplers.

16. The preformed panel of claim 15, wherein each coupler is of one piece construction having a panel abutting or fastening member and a frame member coupling member extending substantially perpendicular relative to the panel abutting or fastening member from a common or shared edge of the panel abutting or fastening member and wherein, when the frame member coupling member is coupled to the inner frame wall of the frame member, the panel abutting or fastening member is substantially planar with the panel abutting wall of the frame member and can be fastened to the panel.

* * * * *